US006784382B2

(12) United States Patent
Yanai et al.

(10) Patent No.: US 6,784,382 B2
(45) Date of Patent: Aug. 31, 2004

(54) PUSH-ON SWITCH

(75) Inventors: Yasunori Yanai, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 25 days.

(21) Appl. No.: 10/386,101

(22) Filed: Mar. 12, 2003

(65) Prior Publication Data

US 2003/0209418 A1 Nov. 13, 2003

(30) Foreign Application Priority Data

Mar. 13, 2002 (JP) ..... 2002-068112
Dec. 20, 2002 (JP) ..... 2002-370316

(51) Int. Cl.[7] ..... H01H 9/00; H01H 13/52; H01H 1/00

(52) U.S. Cl. ..... 200/1 B; 200/406; 200/516; 200/275

(58) Field of Search ..... 200/1 B, 5 R, 200/5 A, 406, 512–517, 275

(56) References Cited

U.S. PATENT DOCUMENTS 3,996,429 A * 12/1976 Chu et al. ..... 200/5 A
4,029,916 A * 6/1977 Chu ..... 200/5 A
4,659,881 A * 4/1987 Dowe ..... 200/5 R
5,898,147 A * 4/1999 Domzalski et al. ..... 200/1 B
6,271,487 B1 * 8/2001 Domzalski et al. ..... 200/1 B
6,489,580 B2 * 12/2002 Yanai et al. ..... 200/406

FOREIGN PATENT DOCUMENTS

JP 11-232962 8/1999

* cited by examiner

*Primary Examiner*—James R. Scott
(74) *Attorney, Agent, or Firm*—McDermott, Will & Emery

(57) ABSTRACT

The first movable contact including a ring portion and projections extended in same width as the ring is arranged against the peripheral fixed contacts and the central fixed contact at the bottom of the switch case in such manner that the ring portion confronts the peripheral fixed contacts at spaced intervals apart.

12 Claims, 22 Drawing Sheets

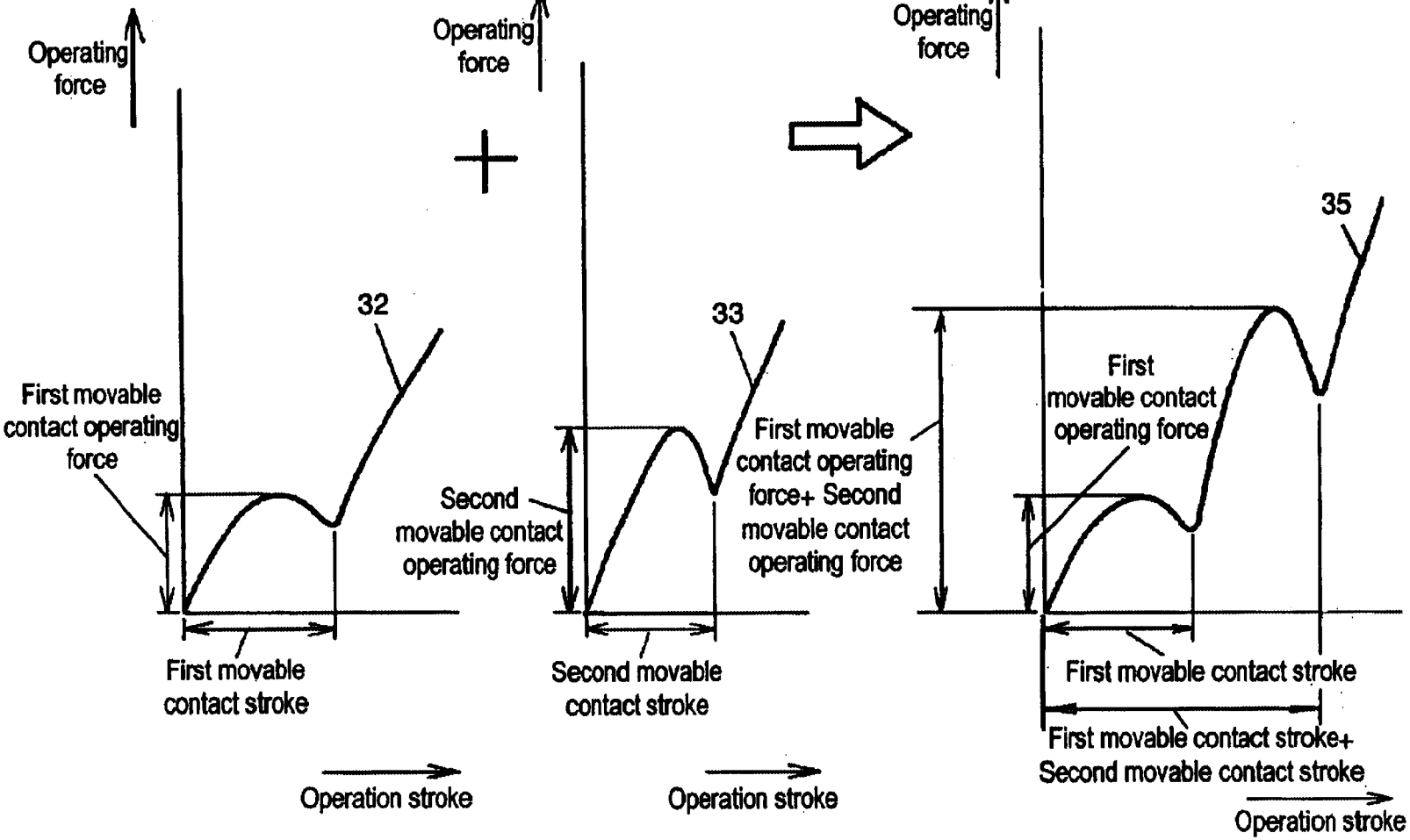
FIG. 12A
Operating force
32
First movable contact operating force
First movable contact stroke
Operation stroke
FIG. 12B
Operating force
33
Second movable contact operating force
Second movable contact stroke
Operation stroke
FIG. 12C
Operating force
35
First movable contact operating force
First movable contact operating force+ Second movable contact operating force
First movable contact stroke
First movable contact stroke+ Second movable contact stroke
Operation stroke

PUSH-ON SWITCH

FIELD OF THE INVENTION

The present invention relates to a two-stage operation push-on switch wherein a first switch operates with a pressing force applied thereto and then a second switch operates with click feeling.

BACKGROUND OF THE INVENTION

A push-on switch used in the input unit of recently available electronic equipment extremely reduced in size and increased in density is required to be compact and narrow width because the mounting space of the switch is limited.

A conventional push-on switch is described with reference to FIG. 26 to FIG. 31.

FIG. 26 is an appearance perspective view of a conventional push-on switch. FIG. 27 is a front sectional view of the switch.

FIG. 28 is a plan view of a switch case that is an essential portion of the switch. FIG. 29 is a plan view of a movable contact that is an essential portion of the switch.

Switch case 1 made of insulating resin is provided with a circular recess 1A at the top thereof. On the inner bottom of the recess 1A are disposed a central fixed contact 2A, and two peripheral fixed contacts 2B, 2C being electrically independent and positioned in point-to-point symmetric relation to each other with the central fixed contact therebetween. At the periphery of the case 1 are arranged connecting terminals 3A to 3C conducting with each fixed contact 2A to 2C.

Movable contact 4 made of elastic sheet metal is formed of a dome portion 5 curved upward and a circular ring portion 7. The diameter of the dome portion 5 is nearly equal to the distance between the centers of the fixed contacts 2B, 2C. The dome portion 5 and the ring portion 7 are connected to each other by a flexible thin connection 6 in such manner that the dome portion 5 is maintained in a state of being sloped against the ring portion 7.

The movable contact 4 is housed in the circular recess 1A of the switch case 1 in such manner that the periphery of the dome portion 5 is positioned at spaced intervals above the peripheral fixed contacts 2B, 2C.

Sheet 8 made of elastic insulating film covers the upper opening of the switch case 1. The sheet 8 is held on the top of the switch case 1 by means of a cover 9 having a through-hole 9A at the center thereof.

The operation of a conventional push-on switch having such a configuration will be described by using the front sectional views of FIG. 30 and FIG. 31.

First, the operation of the first switch is described with reference to FIG. 30. When the dome portion 5 of the movable contact 4 is pressed by operating means 10 (shown by chain double-dashed line) from the through-hole 9A of the cover 9 via the sheet 8, then the connection 6 is flexed. At the time, the dome portion 5 is still in a spherical shape. And, the dome portion 5 moves downward and its periphery comes into contact with the peripheral fixed contacts 2B and 2C. That is, the connecting terminals 3B and 3C become conductive.

Next, the operation of the second switch is described with reference to FIG. 31. After causing the terminals 3B, 3C to become conductive, when the dome portion 5 of the movable contact 4 is further strongly pressed by the operating means 10, the dome portion 5 is elastically reversed downward with click feeling. Then the central of the dome portion 5 comes into contact with the central fixed contact 2A, causing the terminals 3A, 3B and 3C to become conductive.

After that, when the pressing force given by the operating means 10 to the dome portion 5 is released, the dome portion 5 is elastically restored with click feeling upward to the original spherical shape. And, the center of the dome portion 5 moves off from the central fixed contact 2A, causing the second switch to be turned off. Subsequently, as the connection 6 returns to the original state of being sloped upward, the periphery of the dome portion 5 shown in FIG. 27 moves off from the peripheral fixed contacts 2B, 2C, and the first switch is also turned off.

As a prior art document related to the present invention, Japanese Laid-open Patent H11-232962 is well known.

As described above, in the conventional push-on switch, since the circular ring portion 7 is concentrically arranged outside the dome portion 5, the outside shape of the switch case 1 or the outside shape of the push-on switch is to be enlarged. As a result, a large mounting space will be required.

Also, with diversification of recent equipment, two-stage push-on switches as described above are required to be capable of being operated by various operating forces. However, in the case of the conventional switch, the first switch and the second switch are operated by the movable contact 4 with the dome portion 5 and the circular ring portion 7 integrated therein. Accordingly, it is difficult to change the setting of the operating force for each switch.

SUMMARY OF THE INVENTION

The present invention is intended to solve such conventional problem, and the purpose is to provide a two-stage push-on switch being narrow and less in mounting space, wherein it is easy to set the operating force for each switch.

In order to achieve the above purpose, the push-on switch of the present invention comprises:

1) a switch case made of insulating resin opening upward;
2) a central fixed contact disposed on the inner bottom of the switch case;
3) two peripheral fixed contacts disposed with the central fixed contact therebetween on the inner bottom of the switch case;
4) connecting terminals individually electrically connected to the central fixed contact and the two peripheral fixed contacts at the periphery of the switch case;
5) a first movable contact made of elastic sheet metal provided with a hole at the center thereof, wherein the first movable contact includes a ring portion, and a projection extended to the right and left of the ring portion, and the first movable contact is disposed in the switch case in such manner that the ring portion is arranged above the two peripheral fixed contacts in confronting spaced relation thereto;
6) a second movable contact having a dome portion curved upward in spherical shape, which is disposed on the ring portion of the first movable contact; and
7) a driving means having a pressing portion for pressing the dome portion of the second movable contact, which is arranged and vertically movable above the second movable contact.

BRIEF DESCRIPTION OF THE DRAWINGS

FIG. 12 is a feeling curve diagram of the same push-on switch.

DESCRIPTION OF THE PREFERRED EMBODIMENT

The preferred embodiment of the present invention will be described in the following with reference to the drawings. (Preferred Embodiment 1)

Figure 1:
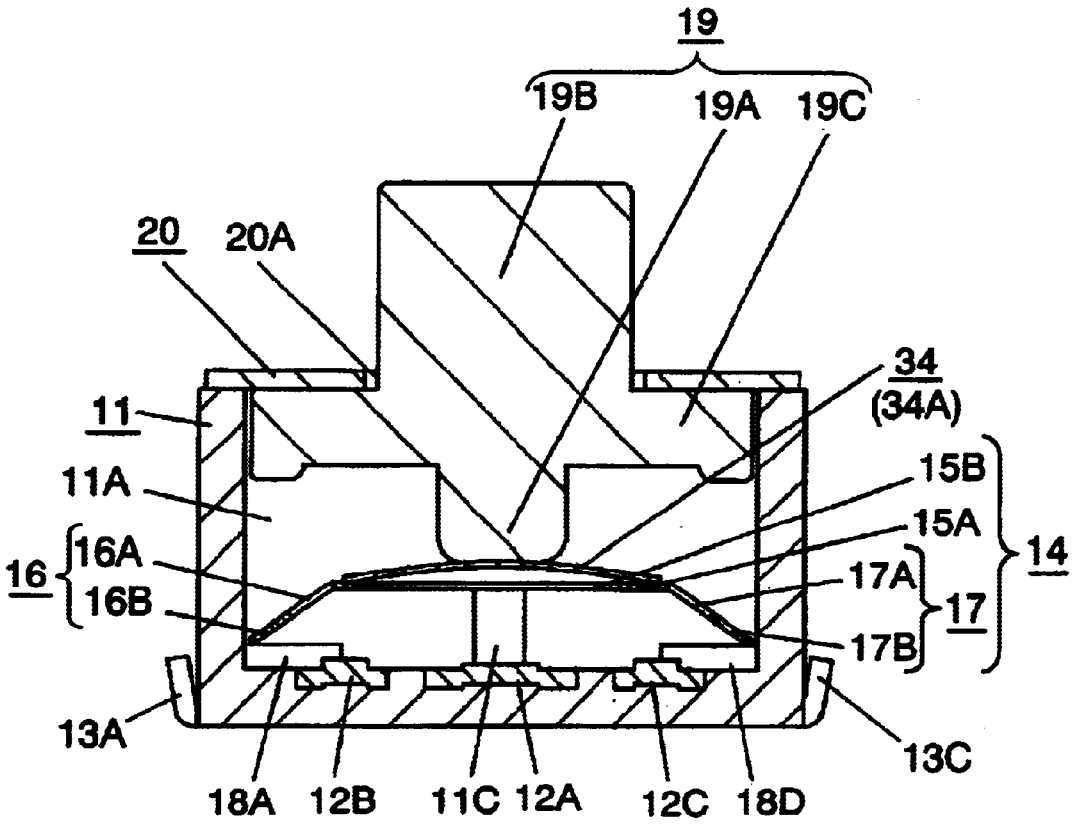
FIG. 1 is a front sectional view of a push-on switch in the first preferred embodiment of the present invention.
Figure 2:
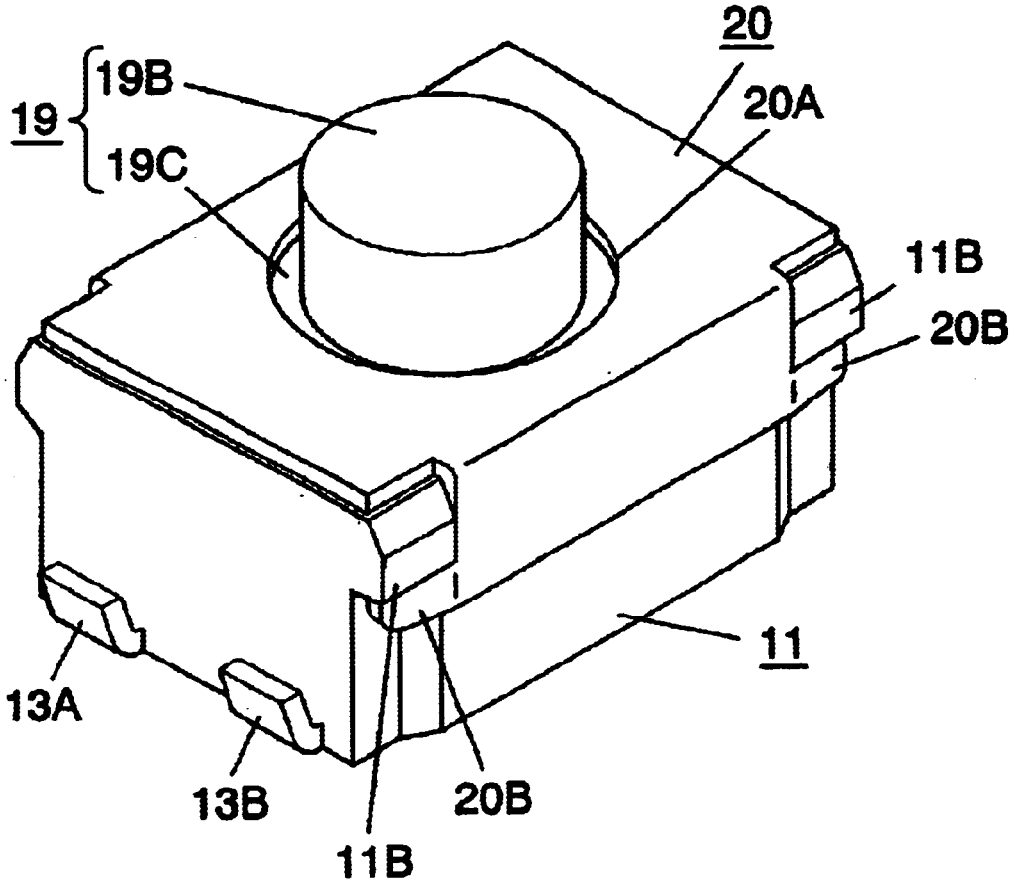
FIG. 2 is an appearance perspective view of the same push-on switch.
Figure 3:
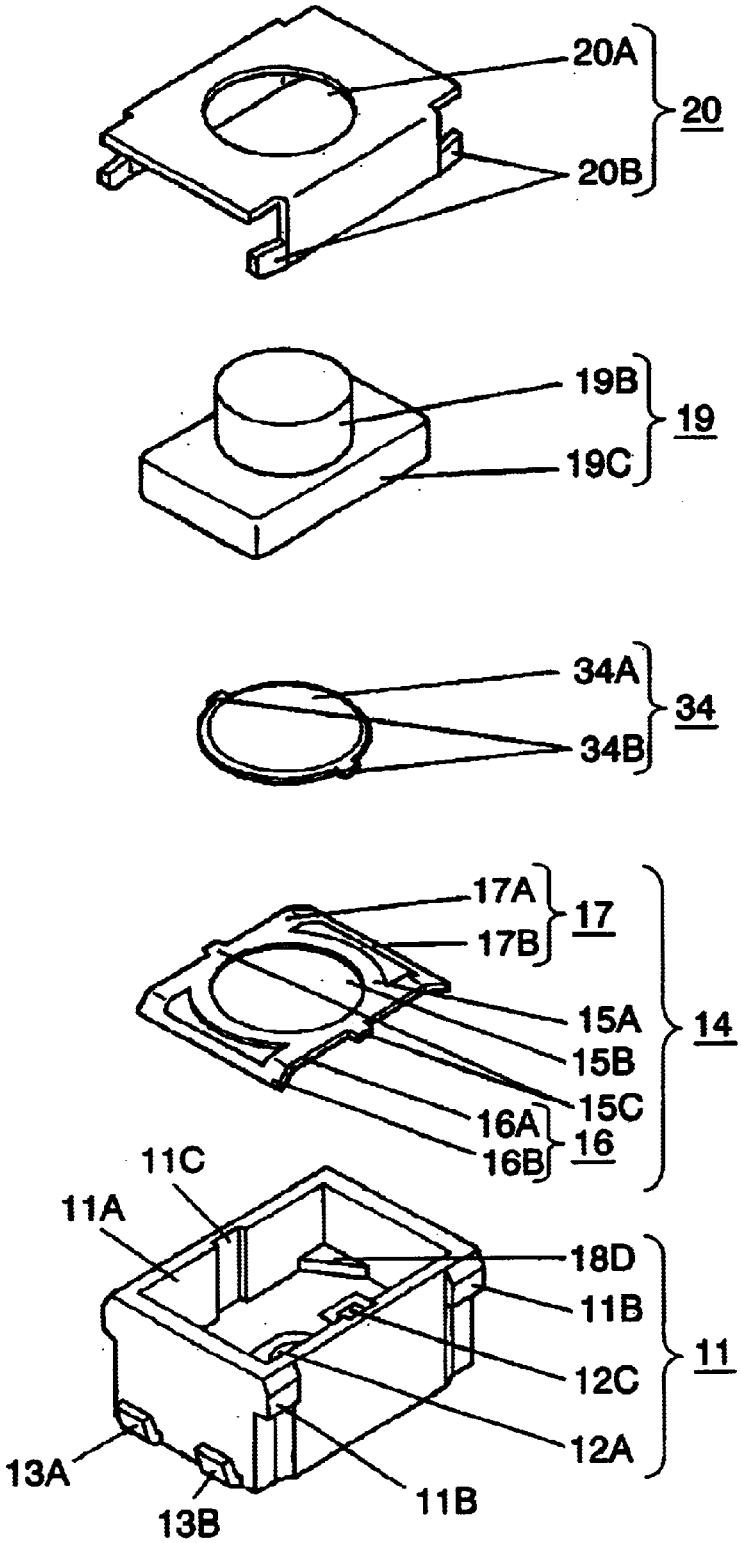
FIG. 3 is an exploded perspective view of the same push-on switch.
Figure 4:
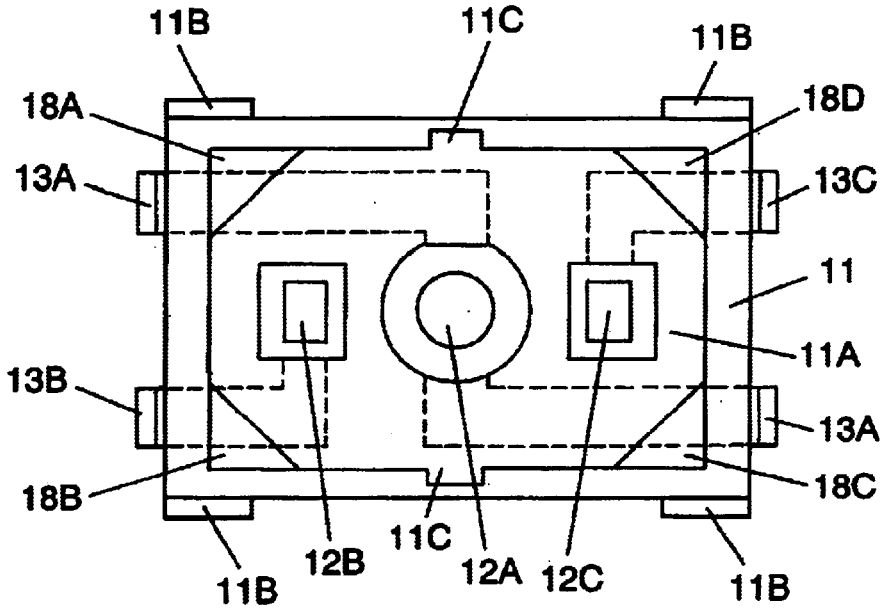
FIG. 4 is a plan view of a switch case that is an essential component of the same push-on switch.

FIG. 1 is a front sectional view of a push-on switch in the first preferred embodiment of the present invention. FIG. 2 is an appearance perspective view of the push-on switch. FIG. 3 is an exploded perspective view of the push-on switch. FIG. 4 is a plan view of switch case 11 of the push-on switch.

The switch case 11 made of insulating resin is upwardly opening, forming recess 11A. The case 11 has a central fixed contact 12A, and two peripheral fixed contacts 12B, 12C being electrically independent and disposed in point-to-point symmetric relation to each other against the central fixed contact disposed therebetween at the inner bottom of the recess 11A. The case 11 is externally provided with connecting terminals 13A to 13C which are respectively conductive with the fixed contacts 12A to 12C. The shape as viewed from above of the recess 11A is rectangular.

Also, the shape as viewed from above of the switch case 11 is thinly rectangular.

Figure 5:
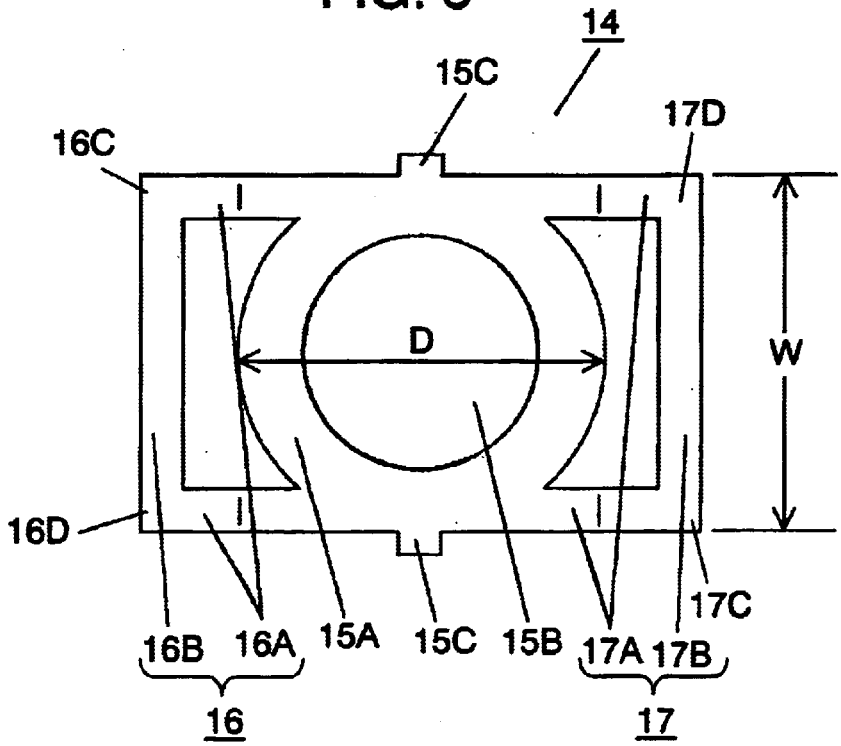
FIG. 5 is a plan view of a first movable contact that is an essential component of the same push-on switch.

FIG. 5 is a plan view of first movable contact 14 in the present preferred embodiment. As shown in FIG. 5, the movable contact 14 made of elastic sheet metal has a ring portion 15A provided with central hole 15B at the center, and projections 16, 17. The diameter of the ring portion 15A is nearly equal to the distance between the centers of the peripheral fixed contacts 12B, 12C. The projections 16, 17 are formed of two pairs of legs 16A, 17A extended from the upper part and the lower part of the ring portion 15A in symmetric relation to the right and left, and connections 16B, 17B connected to the end portions of the upper and lower legs.

And, each of the legs 16A, 17A is bent at the middle position in the same direction.

As shown in FIG. 5, since the width (W) of each of the projections 16, 17 is equivalent to the diameter (D) of the ring portion 15A, the outside shape of the first movable contact 14, as viewed from above, is nearly rectangular. The end portions 16C, 16D and 17C, 17D of the connections 16B, 17B are placed on shoulders 18A to 18D provided at the four corners of the rectangular recess 11A, and the first movable contact 14 is housed in the switch case 11. Consequently, the underside of the ring portion 15A confronts the upper surface of the peripheral fixed contact 12B, 12C at spaced intervals. That is, the central hole 15B of the first movable contact 14 nearly matches the central fixed contact 12A with respect to the central position. The diameter of the central hole 15B of the ring portion 15A is larger than the diameter of the central fixed contact 12.

The width of each of the projections 16, 17 of the first movable contact 14 is preferable to be smaller than the diameter of the ring portion 15A. In the present preferred embodiment, since the arranging stability is higher when the overall width of the first movable contact 14 is greater, the width of the projections 16, 17 is equivalent to the diameter of the ring portion 15A.

Also, it is preferable to place the connections 16B, 17B directly on the inner bottom surface of the switch case 11. In this case, since the legs 16A, 17A are bent downward at the middle position thereof, the distance is maintained between the ring portion 15A of the first movable contact 14 and each of the peripheral fixed contacts 12B, 12C.

Second movable contact 34 having dome portion 34A centrally bent upward in spherical shape is placed on the flat portion of the ring portion 15A of the movable contact 14. And the first movable contact 14 and the second movable contact 34 become conductive.

The central position of the second movable contact 34 nearly matches the central position of the central hole 15B.

Also, driving means 19 made of insulating resin housed and vertically movable in the recess 11A of the switch case 11 is used to press the push-on switch. The driving means 19 includes pressing portion 19A, operating portion 19B and middle portion 19C. The pressing portion 19A in lower position is abutted on the top center of the dome portion 34A of the second movable contact 34. The operating portion 19B in upper position is projected from the through-hole 20A of the cover 20 which covers the opening of the recess 11A.

The middle portion 19C between the pressing portion 19A and the operating portion 19B is rectangular in shape as viewed from above so as to be spaced against the inner walls of the recess 11A. The top surface of the middle portion 19C is abutted on the cover 20.

That is, the driving means 19 is in a state of being held between the upper surface of the dome portion 34A of the second movable contact 34 and the underside of the cover 20.

The cover 20 for covering the opening of the recess 11A is formed by punching and bending a metal sheet. The cover 20 is secured by four claws 20B at the bending portions thereof which are hooked over the four projections 11B at the outer periphery of the switch case 11.

The cover 20 is not always necessary to be formed by using sheet metal, but it is preferable to be formed by using resin material. Also, similar function can be obtained by affixing a film or the like having a through-hole to the surface around the opening of the recess 11A of the switch case 11.

Further, it is preferable to disuse the operating portion 19B of the driving means 19 and to close the opening of the recess 11A of the switch case 11 by affixing a film or the like thereto.

The operation of a push-on switch having such a configuration will be descried in the following.

In the off-state of the switch shown in FIG. 1, when the operating portion 19B of the driving means 19 is pressed, the outer periphery of the middle portion 19C is guided by the inner walls of the recess 11A of the switch case 11 and moved downward, then the pressing portion 19A in lower position pushes down the center of the second movable contact 34.

Figure 6:
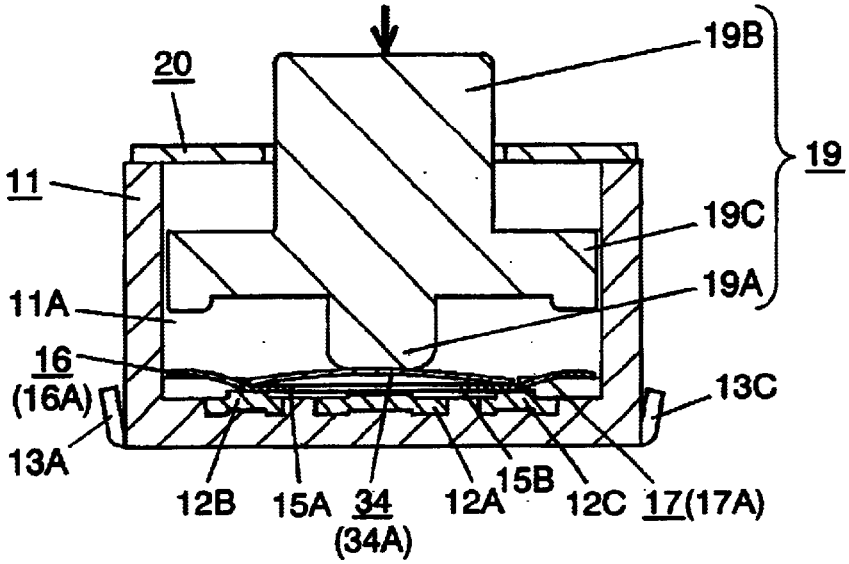
FIG. 6 is a front sectional view for describing the operation mode in pressing operation of the same push-on switch.

At the time, the dome portion 34A of the second movable contact 34 is keeping its original shape as shown in the front sectional view for describing the operation mode in pressing operation as in FIG. 6. That is, the dome shape upwardly curved in spherical shape is still maintained. Maintaining the condition, the legs 16A, 17A of two projections 16, 17 of the first movable contact 14 are elastically deformed with click feeling.

It is also preferable that the first movable contact 14 generates no click feeling when the legs 16A, 17A are elastically deformed.

Thus, the ring portion 15A moves downward and its underside comes into contact with the two peripheral fixed contacts 12B and 12C. As a result, the connecting terminals 13B and 13C (connecting terminal 13B is not shown in FIG. 6) become conductive. That is, the first switch is turned on.

In this case, since the diameter of the central hole 15B of the ring portion 15A is greater than the diameter of the central fixed contact 12A, which are concentric with each other, the ring portion 15A does not come in contact with the central fixed contact 12A. Also, since the second movable contact 34 placed on the ring portion 15A still keeps its original dome shape upwardly curved, the central fixed contact 12A maintains a state of being electrically independent.

Figure 7:
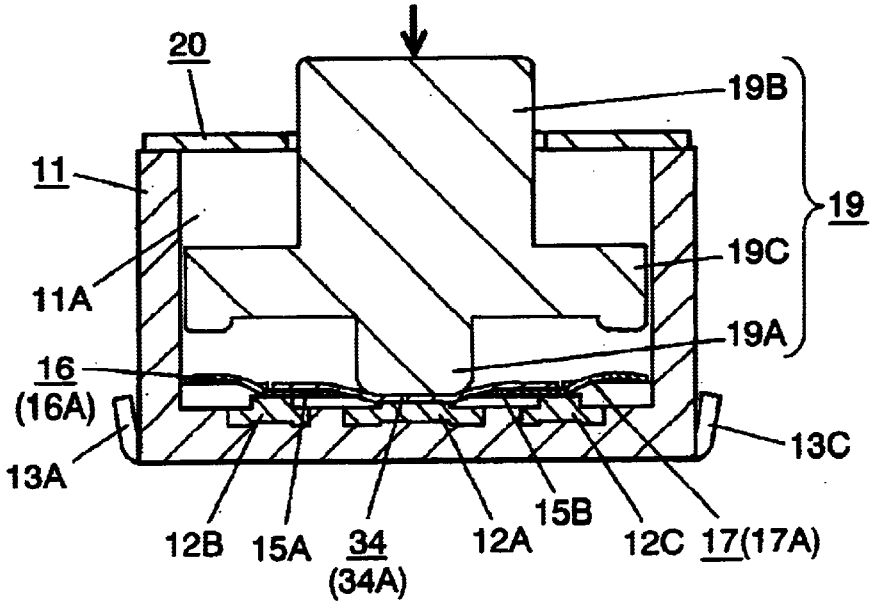
FIG. 7 is a front sectional view for describing the operation mode in pressing operation of the same push-on switch.

Subsequently, when the driving means 19 is further pressed down, the center of the dome portion 34A is elastically reversed downward with click feeling as shown in FIG. 7. And, the underside at the center of the dome portion 34A is exposed from the central hole 15B and comes into contact with the central fixed contact 12A. As a result, the central fixed contact 12A in addition to the fixed contacts 12B, 12C becomes conductive. That is, the second switch is turned on, and conduction is established between the connecting terminals 13A, 13B and 13C.

Next, when the pressing force applied to the operating portion 19B of the driving means 19 is released, the center of the dome portion 34A of the second movable contact 34 is first restored with click feeling to its original dome shape curved upward in spherical shape due to the elastically restoring force. And, the center thereof moves off from the central fixed contact 12A, causing the second switch to be turned off. Subsequently, the end portions of legs 16A, 17A of the first movable contact 14 are elastically restored to their original state of being sloped downward. Thus, the underside of the ring portion 15A moves off from the fixed contacts 12B, 12C, and the first switch is also turned off.

As shown in FIG. 3, the first movable contact 14 and the second movable contact 34 are respectively provided with lugs 15C and 34B. The first movable contact 14 and the second movable contact 34 are built into the case 11, with the lugs 15C and 34B guided along the inner wall grooves 11C of the switch case 11. In this way, the positions of the first movable contact 14 and the second movable contact 34 can be easily regulated, and the arrangement accuracy is stabilized. Further, it is possible to stabilize the behavior of the movable contacts 14 and 34 in the on-off operation of the switch.

The stability can be improved by disposing the lugs 15C of the first movable contact 14 on the central axis passing through the center of the ring portion 15A in a direction perpendicular to the extending direction of the projections 16 and 17.

And, it is preferable to form the lugs 15C of the first movable contact 14 and the lugs 34B of the second movable contact 34 identical in shape with each other because the levels of regulation by the inner wall grooves 11C of the switch case 11 will be equalized. Also, in this case, with the first movable contact 14 and the second movable contact 34 placed one upon another, the lugs 15C and 34B can be easily simultaneously inserted into the inner wall grooves 11C.

As is apparent in the above description, the width of the first movable contact 14 is nearly equal to the diameters of the ring portion 15A and the dome portion 34A, and the width of the switch case 11 in which the first movable contact is housed can be reduced. As a result, it is possible to realize a two-stage push-on switch reduced in width.

With the first switch turned off and the first movable contact 14 being always conductive with a common connecting terminal, the configuration of the switch case will be described in the following.

Figure 8:
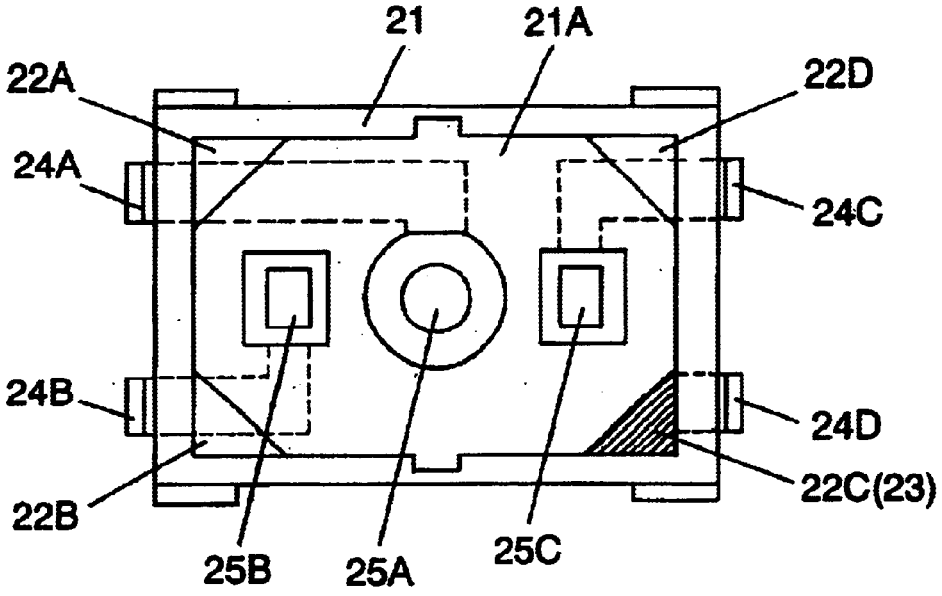
FIG. 8 is a plan view of a switch case that is an essential component in another configuration of the same push-on switch.

FIG. 8 is a plan view of a switch case having another configuration. As shown in FIG. 8, of four shoulders 22A to 22D in the recess 21A of switch case 21, common contact 23 (shown by hatching) is disposed at the shoulder 22C where the end portion 17C of the connection 17B of one of the projections 17 of the first movable contact 14 is placed.

In this case, the switch case 21, unlike the switch case 11, includes one connecting terminal 24A becoming conductive with central fixed contact 25A, and common connecting terminal 24D being in conductive relation with the common contact 23.

The two peripheral fixed contacts 25B, 25C, and the connecting terminals 24B, 24C being conductive therewith, which are arranged in the switch case 21, are same in configuration as those of the above switch case 11.

Figure 9:
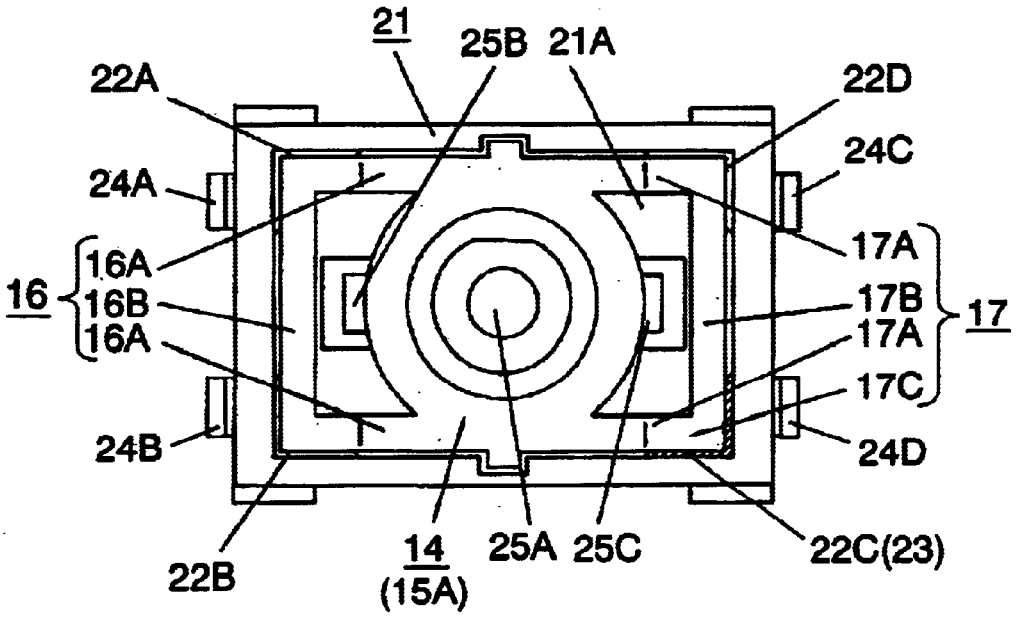
FIG. 9 is a plan view of a first movable contact housed in the switch case of the same push-on switch.

FIG. 9 is a plan view of the switch case 21 with the first movable contact 14 housed therein. As shown in FIG. 9, the first movable contact 14 is housed in the recess 21A of the switch case 21, and subsequently, same as described above, the second movable contact 34, etc. (not shown) are placed on the first movable contact 14.

Figure 10:
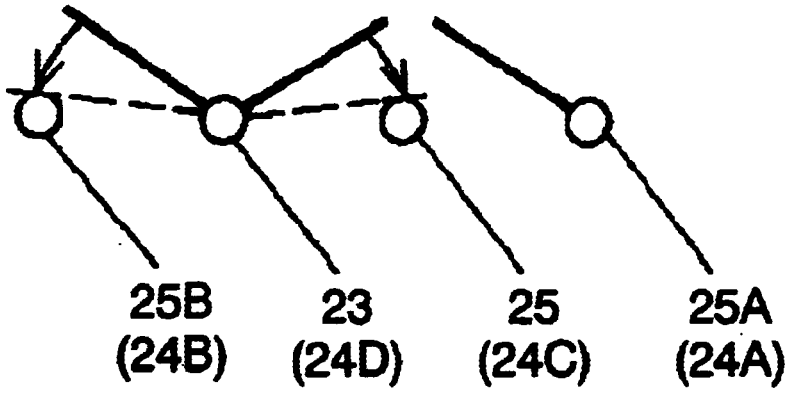
FIG. 10 is a circuit diagram for describing the connected state in pressing operation of the same push-on switch.
Figure 11:
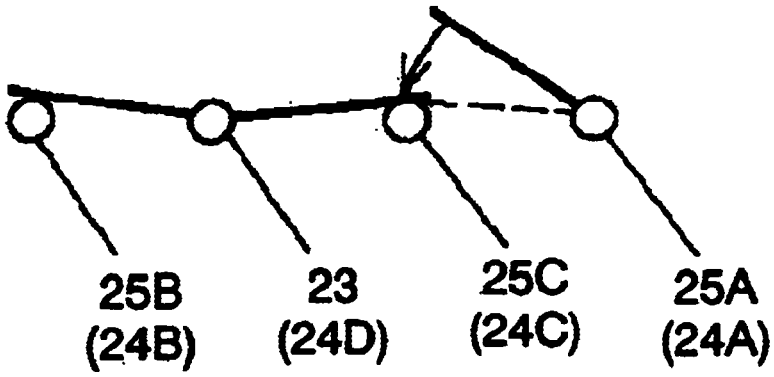
FIG. 11 is a circuit diagram for describing the connected state in pressing operation of the same push-on switch.

In a push-on switch having such configuration, the end portion 17C of one of the projections 17 of the first movable contact 14 is always in conductive relation with the common contact 23 or common connecting terminal 24D. When the driving means 19 (not shown) is pressed, the switch first operates as a first switch, as shown in FIG. 10, then the common connecting terminal 24D and the connecting terminals 24B, 24C become conductive. Next, as shown in FIG. 11, the switch operates as a second switch, then the connecting terminal 24A becomes conductive in addition to the above three connecting terminals.

In that case, the peripheral fixed contacts 25B, 25C of the switch case 21 are not always needed to be electrically independent. It is also preferable if necessary that the contacts are electrically connected with each other at all times.

Next, the method of setting the operating force of each switch is described with reference to the feeling curve diagrams of FIGS. 12A to 12C.

FIG. 12A is a feeling curve of the first movable contact 14. FIG. 12B is a feeling curve of the second movable contact 34. FIG. 12C is a feeling curve of the switch.

The push-on switch of the present preferred embodiment is configured that the second movable contact 34 is placed on the first movable contact 14, and that the second movable contact 34 only moves downward while keeping its dome shape in operation of the first switch. Therefore, the operating force and stroke in operation of the first switch are just the operating force and stroke of the first movable contact 14.

Accordingly, when changing the operating force and stroke of the first switch, it is possible to make the adjustment and setting by changing the shape and material or the like of the first movable contact 14.

The operating force and stroke in operation of the second switch, as shown in FIG. 12, are equivalent to the composition of those of the first movable contact 14 and the second movable contact 34. When changing the above parameters of the second switch, it is possible to make the adjustment and setting by changing the shape and material or the like of any one of the first movable contact 14 and the second movable contact 34.

The product lifetime of the push-on switch mainly depends upon the operation lifetime characteristics of the first movable contact 14 and the second movable contact 34. Therefore, it is possible to easily prolong the lifetime by changing the shape or material of the first movable contact 14 and the second movable contact 34.

As described above, since the first movable contact 14 and the second movable contact 34 are structurally independent, it is possible to easily make the adjustment and setting individually with respect to the operating forces, operating strokes, and operational lifetime characteristics of the first switch and the second switch.

It is also preferable to set the width (W) of the projections 16, 17 of the first movable contact 14 to the diameter of the ring portion 15A. Also, the first movable contact is preferable to be shaped without connections 16B, 17B.

(Preferred Embodiment 2)

Figure 13:
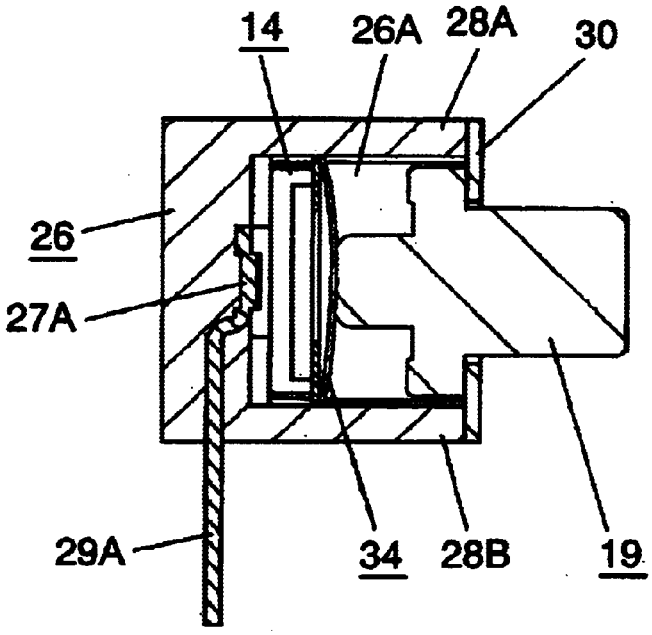
FIG. 13 is a side sectional view of a push-on switch in the second preferred embodiment of the present invention.
Figure 14:
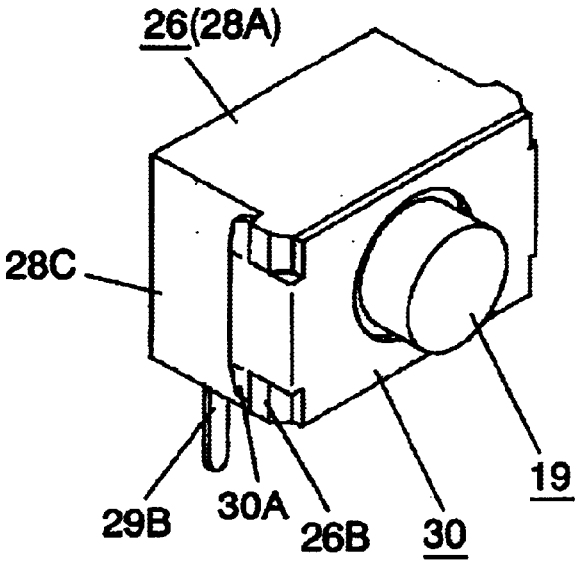
FIG. 14 is an appearance perspective view of the same push-on switch.
Figure 15:
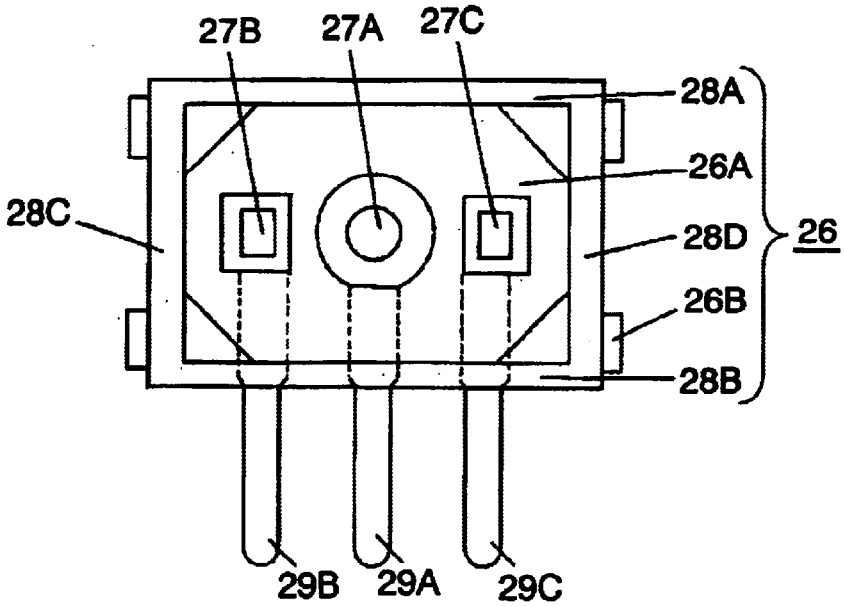
FIG. 15 is a front view of a switch case that is an essential component of the same push-on switch.

FIG. 13 is a side sectional view of a push-on switch in the second preferred embodiment of the present invention. FIG. 14 is an appearance perspective view of the push-on switch. FIG. 15 is a front view of a switch case that is an essential component of the push-on switch. Incidentally, the components having same configuration as in the preferred embodiment 1 are given same reference numerals, and the detailed description is omitted.

The push-on switch of the present preferred embodiment, as against the preferred embodiment 1, is different in the direction of connecting terminals coming out of the switch case.

As shown in FIG. 15, the inner bottom shape of recess 26A of switch case 26 is rectangular in the direction of connecting two peripheral fixed contacts 27B, 27C disposed in point-to-point symmetric relation to each other against the central fixed contact 27A. And, the outer surface of side-wall 28A, 28B parallel to the switch case 26 is flat and long sideways. The distance between the outer surfaces of walls 28A and 28B, being the height direction of the switch case 26, is set as short as possible.

The connecting terminals 29A and 29B, 29C conducting with the central fixed contact 27A and the peripheral fixed contacts 27B, 27C are vertically protruded from the side-wall 28B.

The first movable contact 14, the second movable contact 34, and the driving means 19 are housed in the recess 26A of the switch case 26, the same as in the preferred embodiment 1. Cover 30 has four claws 30A at the bending portions. The four claws 30A are hooked over four projections 26B provided at the outer surfaces of the walls 28C, 28D of the switch case 26, thereby covering the upper opening of the switch case 26.

The operation of the push-on switch of the present preferred embodiment is same as in the preferred embodiment 1, and the description is omitted.

Figure 16:
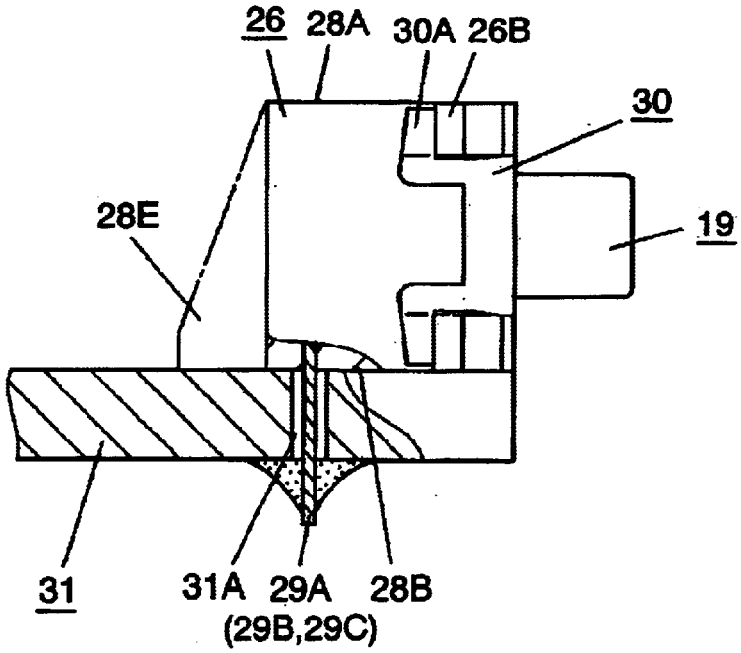
FIG. 16 is a partly sectional side view of the same push-on switch mounted on a wiring board of equipment used.

FIG. 16 is a partly sectional view of a push-on switch of the present preferred embodiment in a state of being mounted on a wiring board of electronic equipment. As shown in FIG. 16, the switch case 26, having the wall 28B as amounting surface, is installed with the connecting terminals 29A to 29C inserted into three holes 31A of wiring board 31 and soldered. That is, it is a type of switch pressed in a direction parallel to the surface of the wiring board 31. Thus, the one based on the present preferred embodiment may realize a mounting board lower in height.

Also, as shown in FIG. 16, since enlargement 28E sharing a plane common with the wall 28B is disposed at the bottom of the switch case 26 in one piece with the switch case 26, it is possible to prevent the switch case 26 from inclining backward when the pressing portion 19A is operated.

In the above preferred embodiment, the switch described is a type such that the connecting terminals 29A to 29C are protruded from the wall 28B, and the connecting terminals 29A to 29C are inserted into the holes 31A of the wiring board 31 and soldered. However, it is also preferable to employ connecting terminals of surface mounting type as the connecting terminals 29A to 29C.

(Preferred Embodiment 3)

The preferred embodiment 3 is different in configuration of contacts and the like as against the push-on switch of the preferred embodiment 1. The same components as in the preferred embodiment 1 are given same reference numerals, and the detailed description is omitted.

Figure 17:
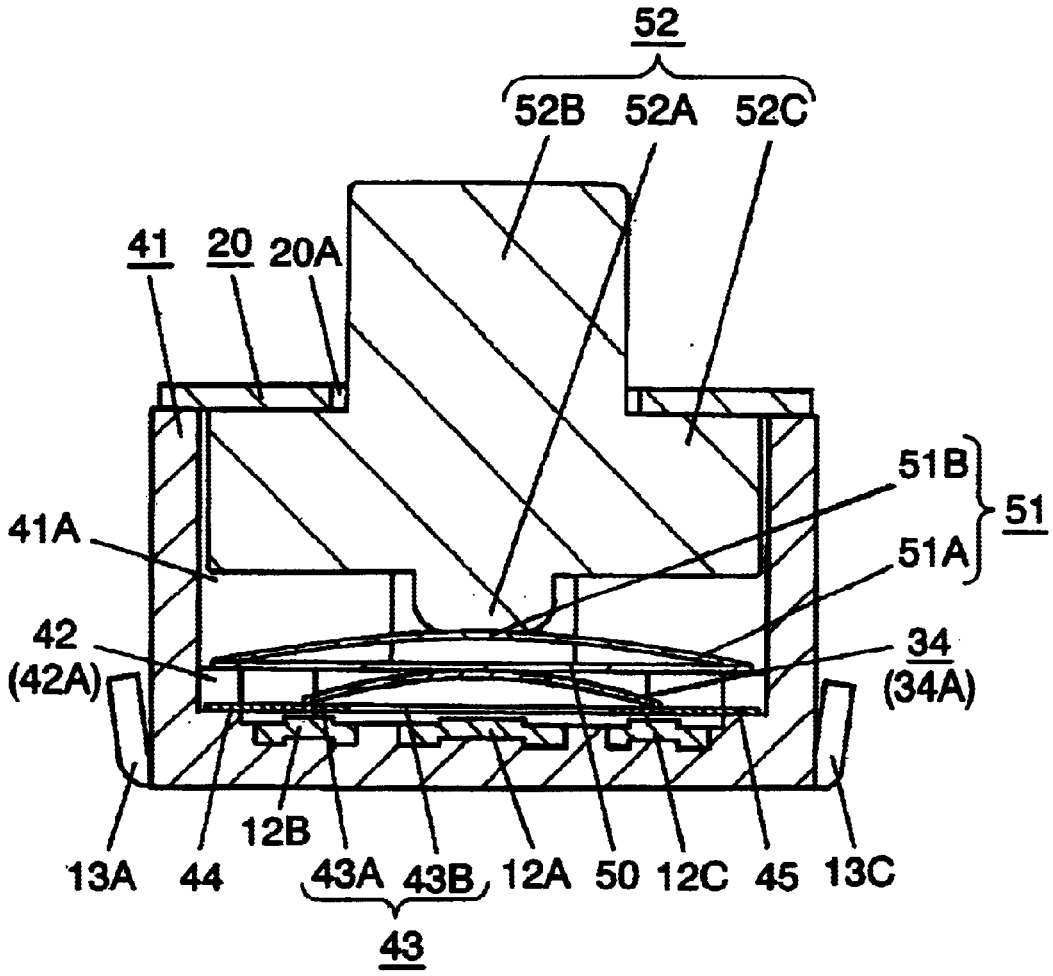
FIG. 17 is a side sectional view of a push-on switch in the third preferred embodiment of the present invention.
Figure 18:
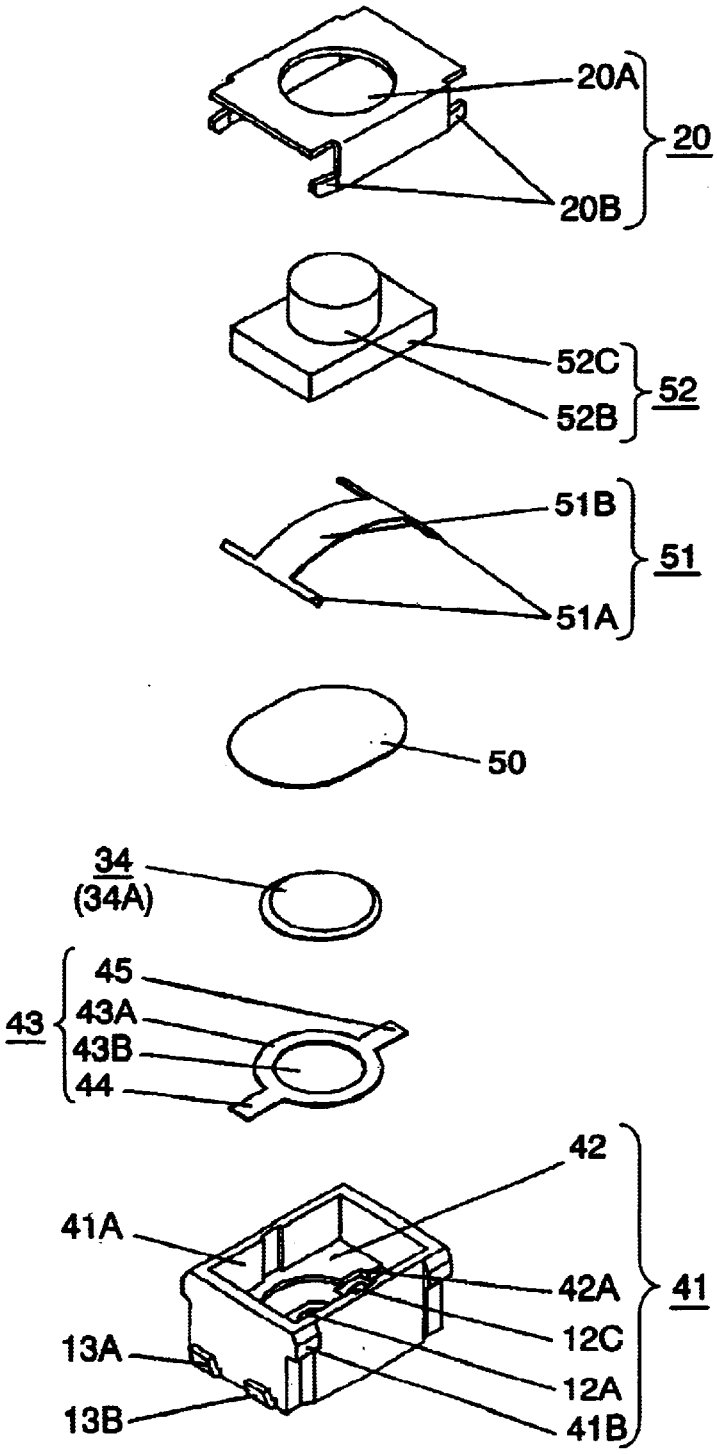
FIG. 18 is an exploded perspective view of the same push-on switch.

FIG. 17 is a side sectional view of a push-on switch of the third preferred embodiment, and FIG. 18 is an exploded perspective view of the push-on switch.

As shown in the figure, the external form of switch case 41 and of the form the recess 41A, same as in the preferred embodiment 1, are shaped long and rectangular as viewed from above in the direction of connecting the central fixed contact 12A disposed on the inner bottom of recess 41A and two peripheral fixed contacts 12B, 12C disposed in point-to-point symmetric relation to each other against the central fixed contact disposed therebetween. And, the connecting terminals 13A to 13C of the fixed contacts 12A to 12C are protruded from the periphery of the case 41.

Middle shoulder 42 is disposed at the periphery of the inner bottom of the case 41 where the fixed contacts 12A to 12C are arranged.

The middle shoulder 42 is provided with grooves 42A in a direction perpendicular to the short side portion of the switch case 41. The grooves 42A are formed on a straight line that connects the fixed contacts 12A to 12C. The bottoms of the grooves 42A are higher than the inner bottom of the case 41.

First movable contact 43 made of elastic sheet metal comprises ring portion 43A, projections 44, 45 extended to the right and left from ring portion 43A in point-to-point relation to the center of the ring portion 43A. Each of the projections 44, 45 is in the form of single leg being constant in width. Also, the first movable contact 43 having the ring portion 43A and projections 44, 45 is in the form of flat plate.

As the projections 44, 45 are guided by the grooves 42A, the first movable contact 43 is housed into the switch case 41.

In this condition, the underside of the ring portion 43A of the first movable contact 43 confronts the peripheral fixed contacts 12B, 12C spaced apart.

The diameter of central hole 43B of the ring portion 43A is greater than the diameter of the central fixed contact 12A. With the first movable contact housed in the case 41, the center of the ring portion 43A is nearly aligned with the center of the fixed contact 12A Since the first movable contact 43 can be formed only by punching a metal plate, it is possible to easily form the contact with high accuracy.

And the second movable contact 34 is placed on the ring portion 43A and is housed into the recess 41A of the switch case 41, thereby forming a switch contact portion.

In the above arrangement, the movable contacts 43 and 34 are electrically conductive. The projections 44, 45 of the first movable contact 43 become flexed with an operating force lower than the reversing force of the second movable contact 34 applied thereto.

With the second movable contact housed in the case 41, the central position is nearly aligned with the central position of the central hole 43B. And, the second movable contact 34 confronts the central fixed contact 12A located thereunder.

The second movable contact 34 in the present preferred embodiment is a type of contact without the lugs 34B shown in the preferred embodiment 1. The periphery position of the second movable contact 34 is horizontally regulated by the inner walls of the middle shoulder 42 of the switch case 41.

The peak portion of the second movable contact 34 is positioned and affixed to the back of the central portion of flexible insulating sheet 50 having adhesive layer on the back thereof. The back of the peripheral portion of the sheet 50 is affixed onto the middle shoulder 42 of the switch case 41 and thus secured on the switch case 41. As a result, the sheet 50 covers the switch contact portion.

Since the switch contact portion is closed by the insulating sheet 50, it is possible to prevent dust or the like from getting into the switch contact portion.

And, spring 51 capable of reversing with click feeling is disposed on the insulating sheet 50. The driving means 52 is activated upward by the spring 51.

That is, the spring 51 is formed of a elastic metal plate with specified width and arch-shaped as viewed from side. The lower end portion 51A at each end of the spring 51 is placed on the middle shoulder 42 of the switch case 41. And, the pressing portion 52A of the driving means 52 elastically abuts the peak portion 51B of the spring 51.

The peak portion 51B of the spring 51, the pressing portion 52A of the driving means 52, and the ring portion 43A are nearly concentric with each other on a straight line.

The operating portion 52B of the driving means 52 is protruded upward from the through-hole 20A of the cover 20. And, with the upwardly activating force of the spring 51 applied thereto, the top surface of middle portion 52C of the driving means 52 abuts the underside of the cover 20.

The middle portion 52C of the driving means 52 is dimensionally spaced apart from the inner walls of recess 41A of the switch case 41, and has a rectangular plate shape. And, the periphery of the middle portion 52C is guided by the inner walls of the recess 41A of the switch case 41. That is, the driving means 52 is arranged so as to be vertically movable.

The cover 20 for covering the recess 41A of the switch case 41 is secured with four claws 20B which are hooked over projections 41B (see FIG. 18) provided at the side periphery of the switch case 41.

The operation of a push-on switch of the present preferred embodiment will be described in the following.

With the switch shown in FIG. 17 turned off, when the operating portion 52B of the driving means 52 is pressed, the driving means 52 moves downward with the outer periphery of the middle portion 52C guided by the inner walls of the recess 41A of the switch case 41. As a result, the pressing portion 52A applies a downward pressing force to the peak portion 51B of the spring 51.

The spring 51 is reversed with click feeling when the pressing force exceeds a predetermined level. And, the underside of the peak portion 51B pushes down the central top surface of the dome portion 34A of the second movable contact 34 via the insulating sheet 50.

The downward pressing force applied to the second movable contact 34 is simultaneously applied to the first movable contact 43. Due to the pressing force applied to the movable contacts 43 and 34, the projections 44, 45 of the first movable contact 43 is elastically deformed downward, causing the ring portion 43A to move downward. At the time, since the projections 44, 45 of the first movable contact 43 are elastically deformed with a force lower than the reversing force of the second movable contact 34, the second movable contact 34 is not reversed, keeping its original dome shape curved upwardly.

Figure 19:
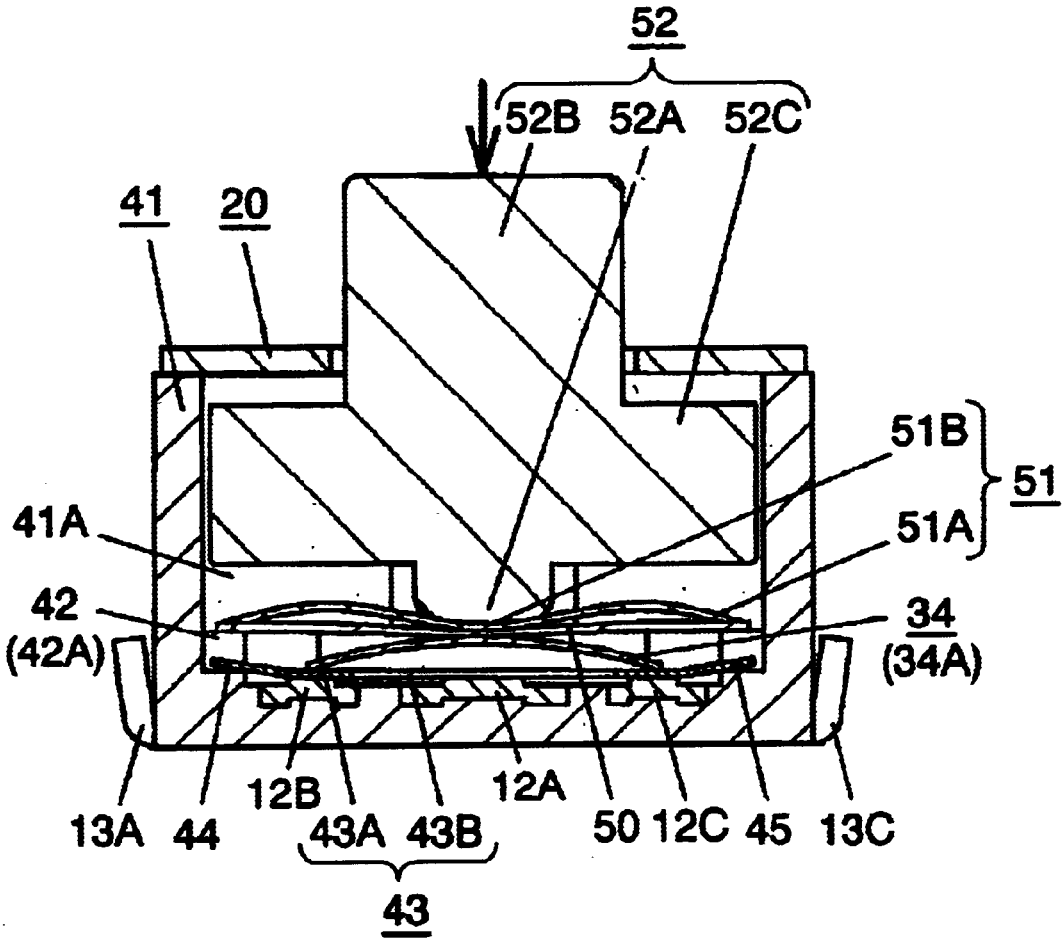
FIG. 19 is a front sectional view for describing the operation mode in pressing operation of the same push-on switch.

And, as shown in FIG. 19, the underside of the ring portion 43A comes into contact with two peripheral fixed contacts 12B and 12C. That is, conduction is established between the connecting terminals 13B and 13C (connecting terminal 13B is not shown in FIG. 19), causing the first switch to be turned on.

At the time, since the second movable contact 34 is still in dome shape curved upwardly, the central fixed contact 12A maintains a state of being electrically independent.

In the above first-stage pressing operation, the projections 44, 45 of the first movable contact 43 are elastically deformed with a relatively light force. Therefore, a click feeling due to the reversing operation of the spring 51 is generated almost simultaneously with the timing of conduction between the peripheral fixed contacts 12B and 12C.

Figure 20:
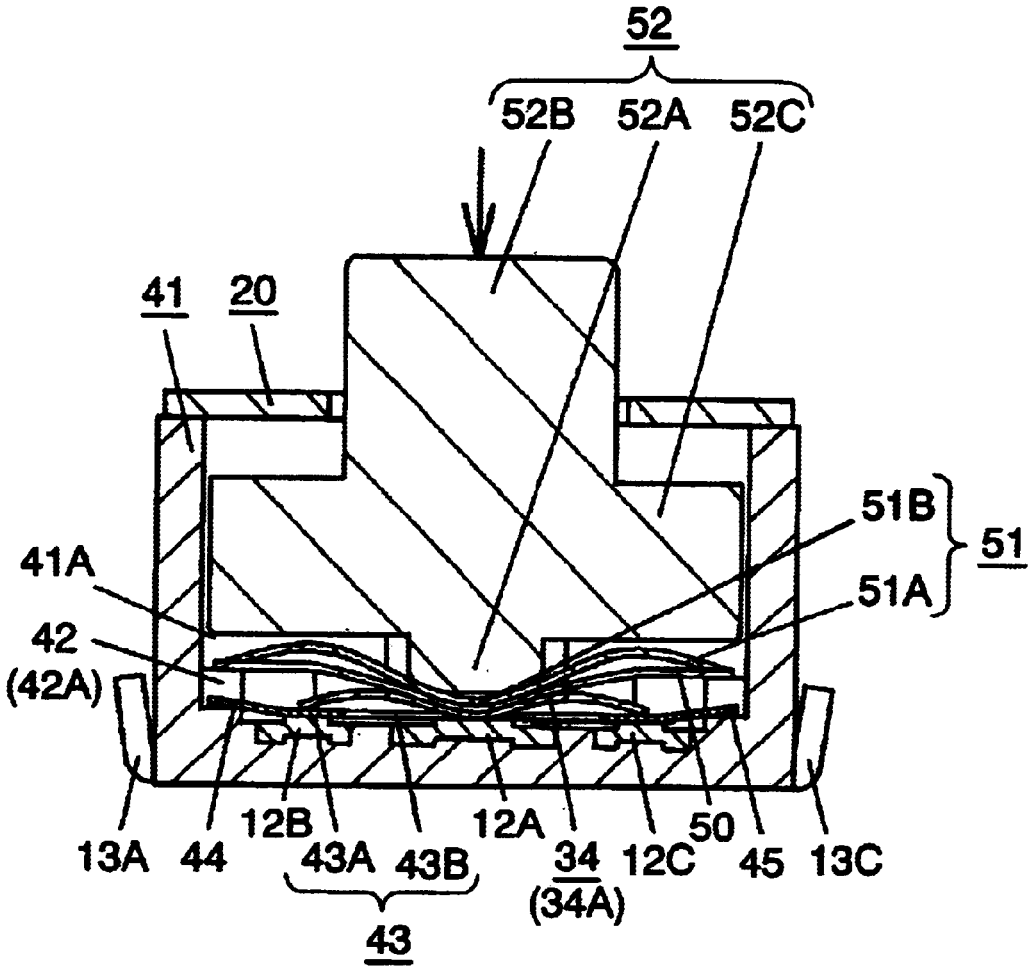
FIG. 20 is a front sectional view for describing the operation mode in pressing operation of the same push-on switch.

Next, when the driving means 52 is further depressed, the pressing force is applied to the central top surface of the dome portion 34A via the spring 51 and the insulating sheet 50. And, as shown in FIG. 20, the second movable contact 34 is reversed with click feeling to be curved upward.

As a result, the underside at the center of the second movable contact 34 comes into contact with the central fixed contact 12A, causing the peripheral fixed contacts 12B, 12C to become conductive with the central fixed contact 12A. That is, the second switch is turned on.

In that case, since the spring 51 is already in a state of being reversed, a click feeling at the second stage can be obtained when the second movable contact 34 is reversed.

When the pressing force to the operating portion 52B of the driving means 52 is released, the center of the dome portion 34A is elastically restored to its original dome shape being spherical. And, the projections 44, 45 are restored to their original flat shape. Also, the spring 51 is also restored to its original arcuate shape curved upward, pushing the driving means 52 back to the original position.

In this way, the underside at the center of the dome portion 34A of the second movable contact 34 moves off from the central fixed contact 12A, and the under side of the ring portion 43A of the first movable contact 43 also moves off from the peripheral fixed contacts 12B and 12C, causing the fixed contacts 12A to 12C to be returned to a state of being electrically independent. That is, as shown in FIG. 17, both of the first and second switches are turned off.

By using the spring 51 properly and selectively, it is possible to easily manufacture switches being different in click feeling of the first switch or different in operating force in the first-stage operation.

Also, since the driving means 52 is activated upward by the spring 51, and is held between the spring 51 and the cover 20, the driving means 52 is free from excessive looseness during non-operation mode.

In the present preferred embodiment, the driving means 52 is positioned higher by the spring 51. Accordingly, if the driving means 52 is accidentally touched, it is possible to prevent the second movable contact 34 from being pushed by the pressing portion 52A of the driving means 52 via the insulating sheet 50 thereby causing the first movable contact 43, which is elastically deformed with a relatively light force without a click feeling, to come into contact by mistake with the peripheral fixed contacts 12B, 12C.

Also, by making the reversing force of the second movable contact 34 relatively great and increasing the ratio of operating force (for example, 1.5 times or over) to the operating force of the spring 51, it is possible to realize an easy-to-use push-on switch.

(Preferred Embodiment 4)

The push-on switch of the preferred embodiment 4 employs a spring different in shape as against the preferred embodiment 3.

In the preferred embodiment 4, the same components as those in the preferred embodiments 1 and 3 are given same reference numerals, and the detailed description is omitted.

Figure 21:
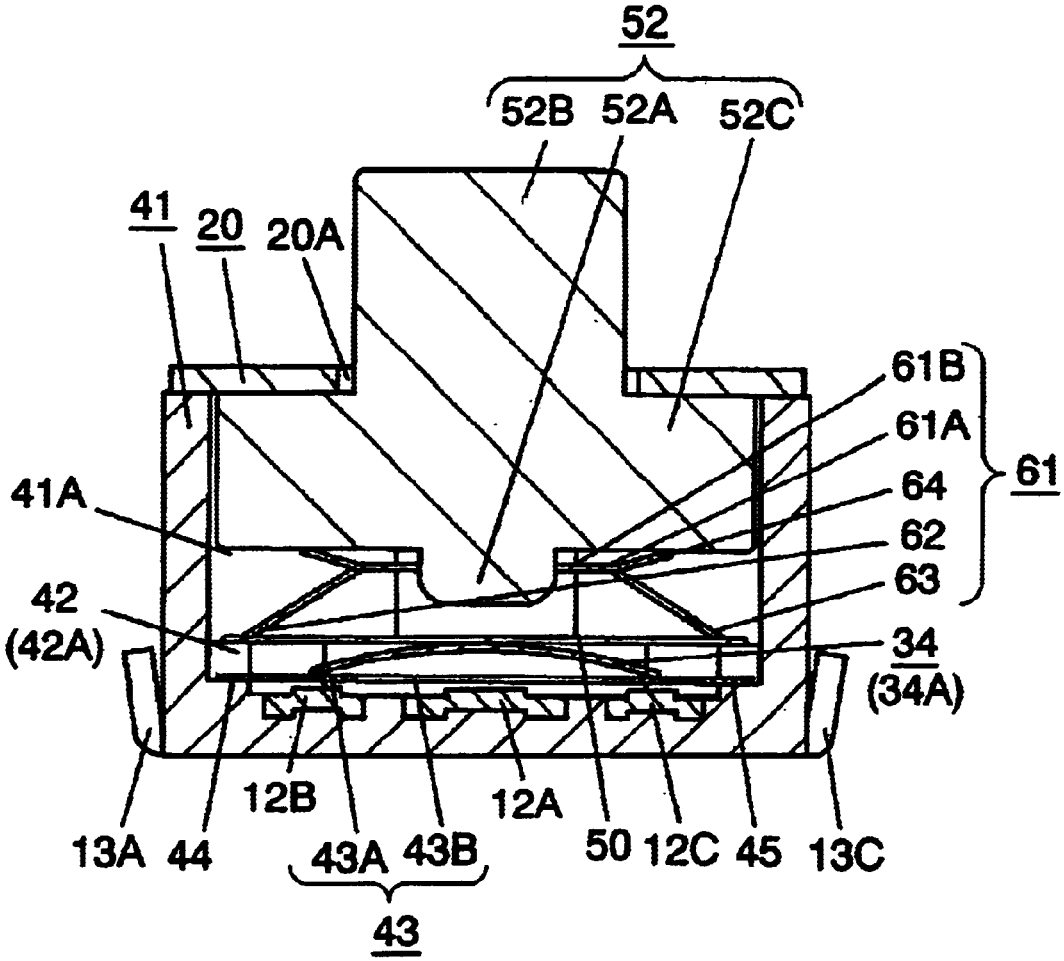
FIG. 21 is a side sectional view of a push-on switch in the fourth preferred embodiment of the present invention.
Figure 22:
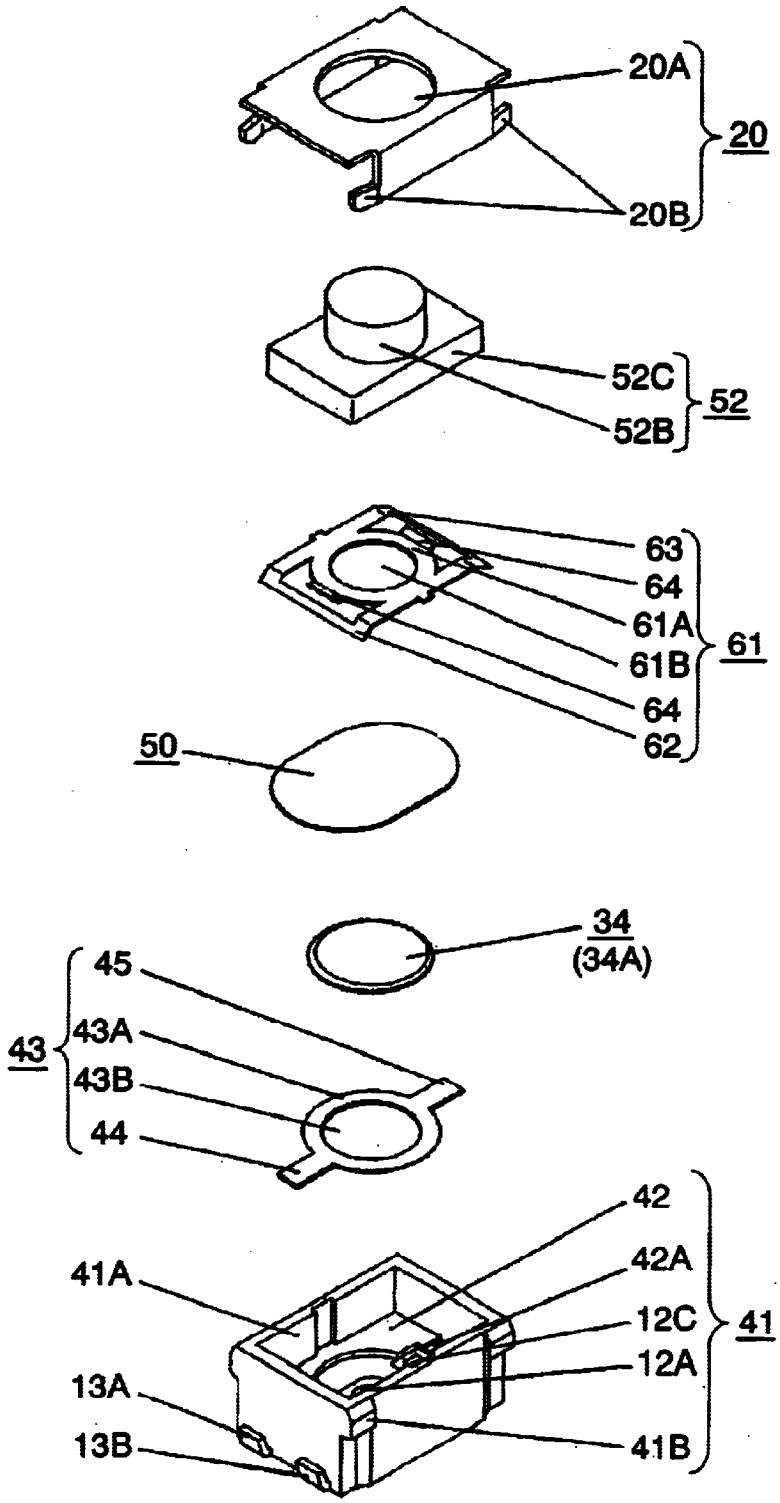
FIG. 22 is an exploded perspective view of the same push-on switch.

FIG. 21 is a side sectional view of a push-on switch in the fourth preferred embodiment of the present invention, and FIG. 22 is an exploded perspective view of the push-on switch.

As shown in the figure, also in the present preferred embodiment, there are provided peripheral fixed contacts 12B, 12C, central fixed contact 12A, flat-form first movable contact 43, and second movable contact 34 placed on ring portion 43A of the first movable contact 43, by which a switch contact portion is formed the same as in the preferred embodiment 3.

The first movable contact 43, same as in the preferred embodiment 3, is positioned with projections 44, 45 protruded sideways of the ring portion 43A in grooves 42A formed in middle shoulder 42 of the switch case 41. The shape of the second movable contact 34 is identical with that of the preferred embodiment 3.

Insulating sheet 50 with the central peak portion of the second movable contact 34 affixed thereto at a predetermined position is securely affixed to the middle portion 42 of the switch case 41 in such manner as to cover the switch contact portion.

Spring 61 is disposed on the middle shoulder 42 of the switch case 41 via the sheet 50. The driving means 52 is disposed on the spring 61 so that it is vertically movable. The upper surface of the middle portion 52C of the driving means 52 is in contact with the underside of the cover 20 fitted to the switch case 41 so as to cover the recess 41A of the switch case 41. Thus, the upward movement of the driving means 52 is regulated. In this condition, the lower end of the pressing portion 52A of the driving means 52 is kept at spaced intervals away from the insulating sheet 50.

The switch case 41, the first and second movable contacts 43 and 34, and the driving means 52 are same as those in the preferred embodiment 3 with respect to the shape, configuration, and arrangement.

And, the spring 61 disposed in the recess 41A of the switch case 41 is nearly identical in shape with the first movable contact 14 in the preferred embodiments 1 and 2.

That is, the spring 61, same as for the first movable contact in the preferred embodiment 1 or the preferred embodiment 2, comprises ring portion 61A at the center, and projections 62, 63 provided sideways of the ring portion 61A are bent downward at the mid-portion thereof. However, a click feeling is not generated during the operation.

The ring portion 61A of the spring 61 and the ring portion 43A of the first movable contact 43 are opposed to each other with the insulating sheet 50 and the second movable contact 34 therebetween.

Also, the spring 61 is provided with a pair of supports 64 at the opposite positions of the periphery of the ring portion 61A. The paired supports 64 are bent upward. The underside of the middle portion 52C of the driving means 52 is placed on the ends of the supports 64.

The pressing portion 52A of the driving means 52 is inserted into the central hole 61B of the ring portion 61A. The lower end thereof is positioned under the ring portion 61A, but there is provided a predetermined space between the lower end portion and the upper surface of the insulating sheet 50 as described above.

The pressing portion 52A of the driving means 52 is positioned above the central portion of the second movable contact 34.

The operation of the push-on switch in the present preferred embodiment having such configuration is described in the following.

First, in the state of FIG. 21, when the pressing portion 52B disposed above the driving means 52 is pressed, the driving means 52 moves downward with the outer periphery of the middle portion 52C guided by the inner walls of the recess 41A of the switch case 41. Thus, the middle portion 52C pushes down the support 64 of the spring 61.

Figure 23:
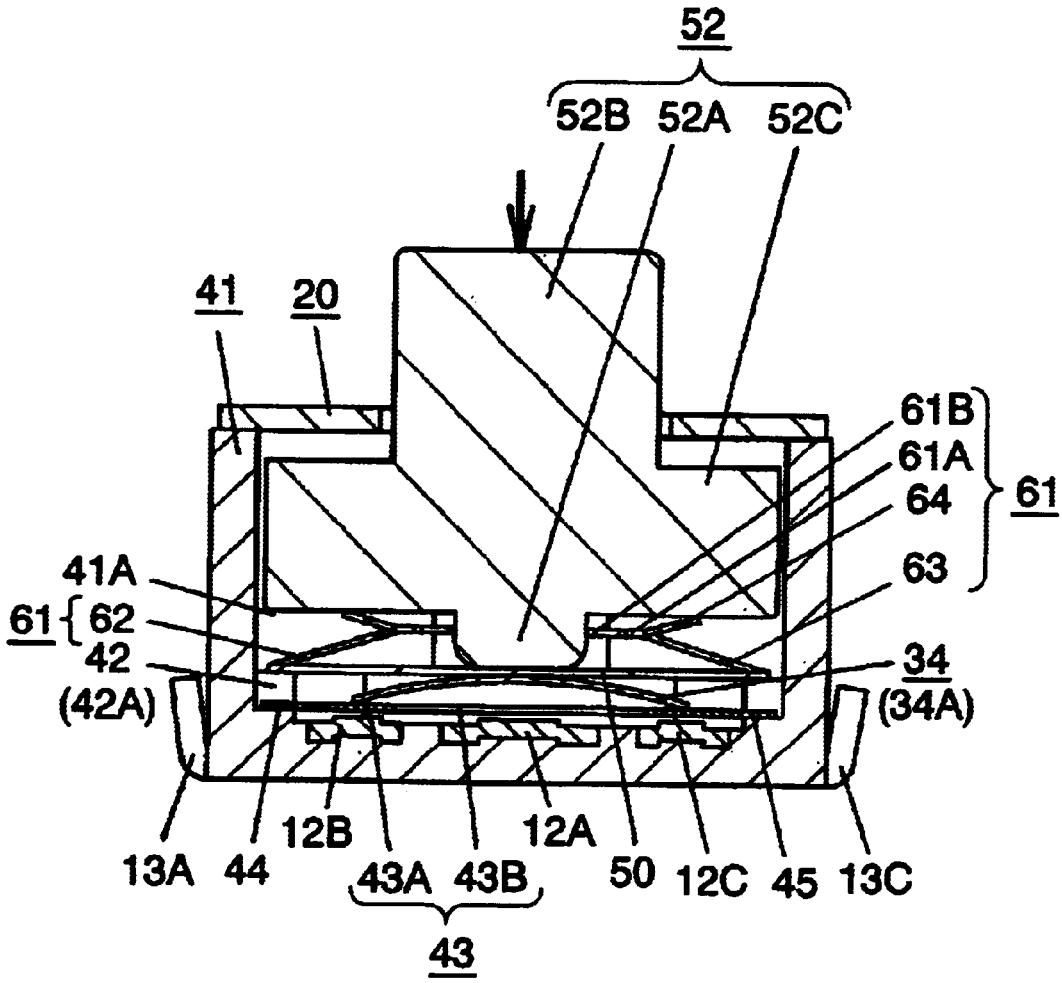
FIG. 23 is a front sectional view for describing the operation mode in pressing operation of the same push-on switch.

Next, as shown in FIG. 23, the projections 62, 63 disposed at the side of the ring portion 61A of the spring 61 become flexed, then the pressing portion 52A of the driving means 52 first abuts the insulating sheet 50.

Figure 24:
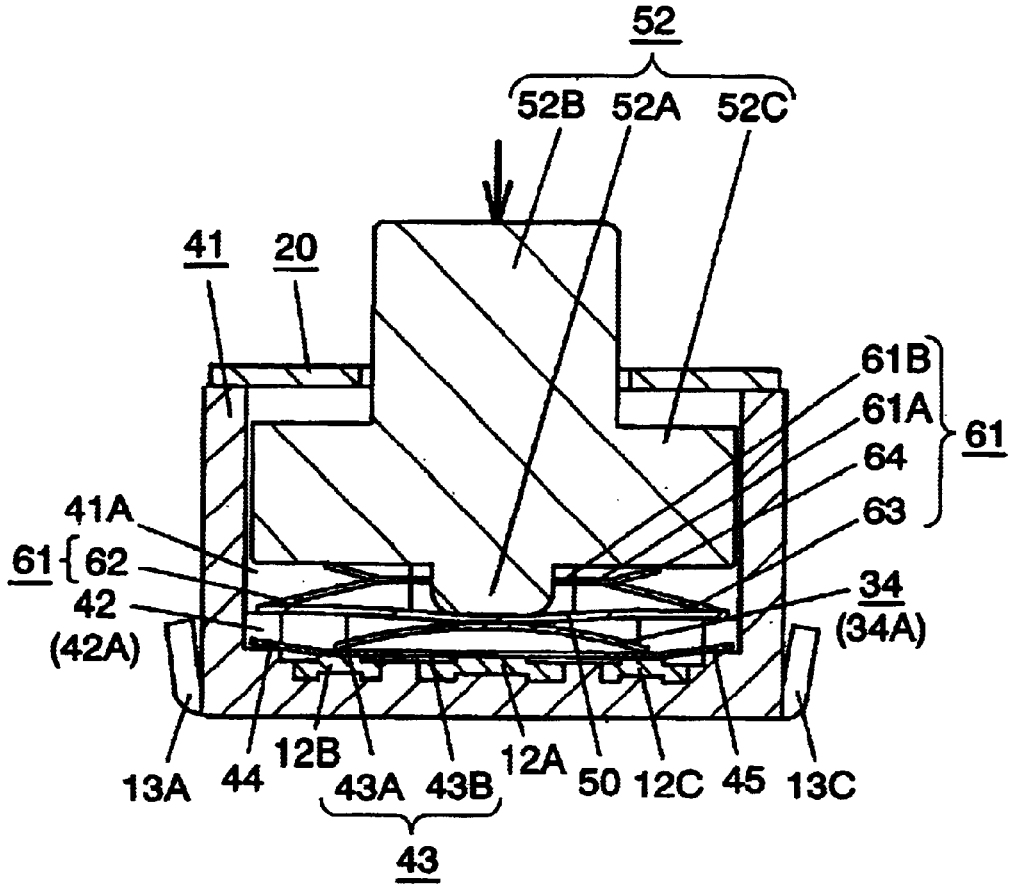
FIG. 24 is a front sectional view for describing the operation mode in pressing operation of the same push-on switch.

From this state, the pressing force to the driving means 52 is applied to the movable contacts 43 and 34 via the insulating sheet 50. Next, the projections 44, 45 of the first movable contact 43 which may be elastically deformed with a force lower than the reversing force of the second movable contact 34 start to become elastically deformed. And, as shown in FIG. 24, the ring portion 43A of the first movable contact 43 moves downward. And the underside of the ring portion 43A comes into contact with the two peripheral fixed contacts 12B and 12C, establishing conduction therebetween. That is, the first switch is turned on.

At the time, the central fixed contact 12A maintains a state of being electrically independent.

Figure 25:
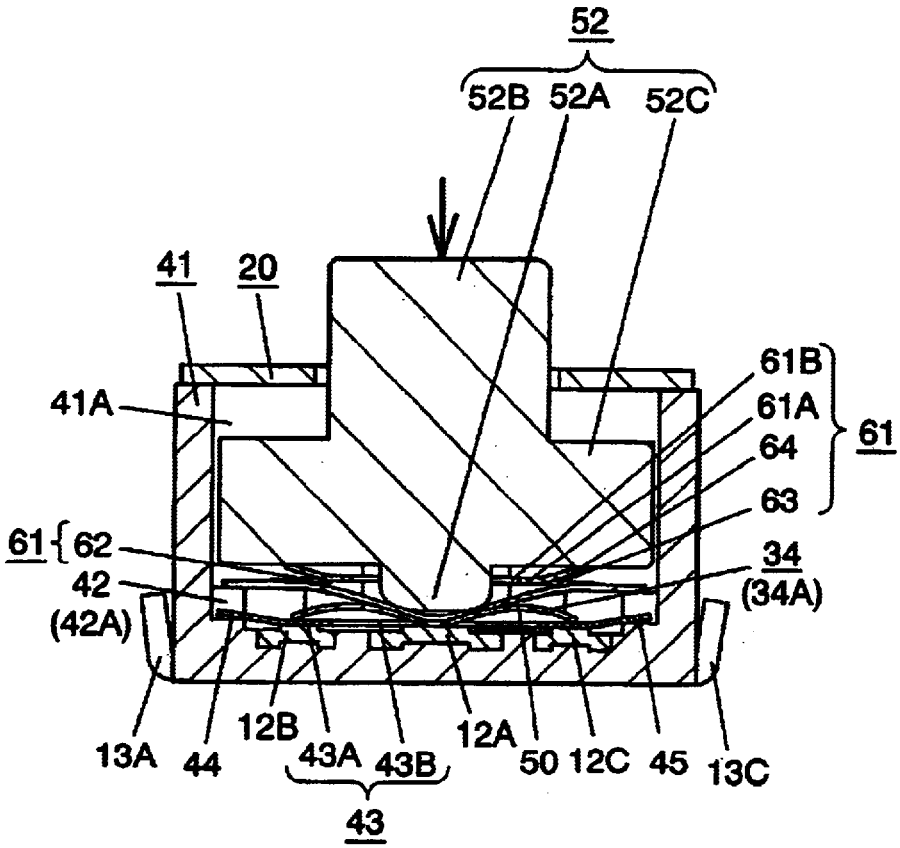
FIG. 25 is a front sectional view for describing the operation mode in pressing operation of the same push-on switch.
Figure 26:
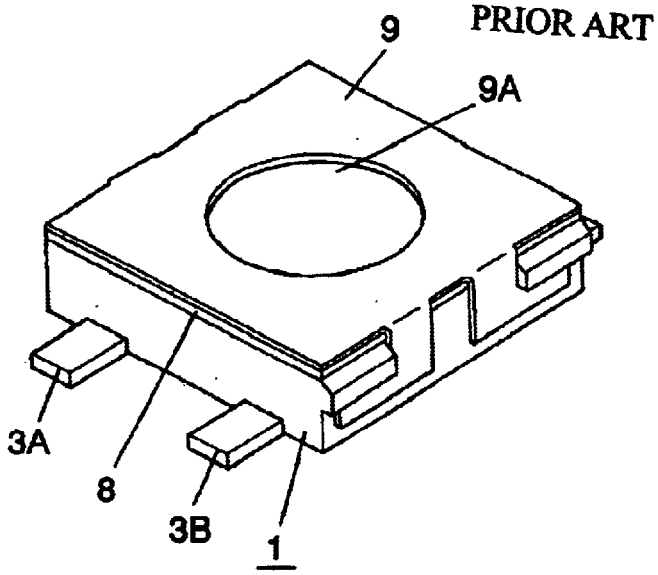
FIG. 26 is an appearance perspective view of a conventional push-on switch.
Figure 27:
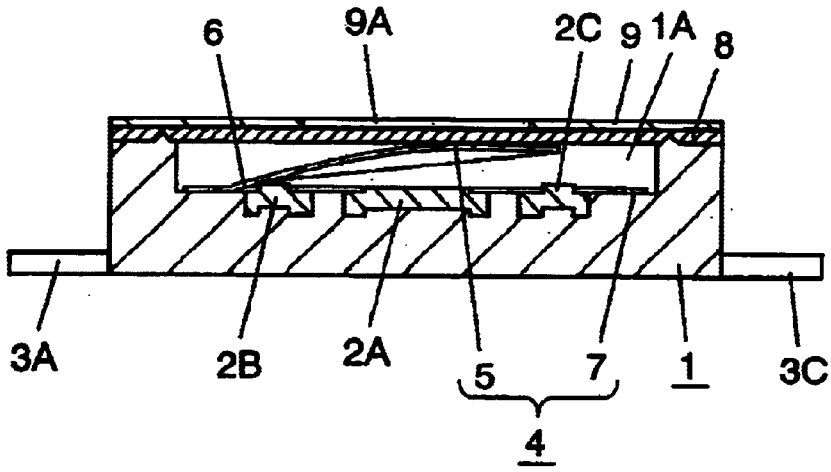
FIG. 27 PRIOR ART
FIG. 27 is a front sectional view of the same push-on switch.
Figure 28:
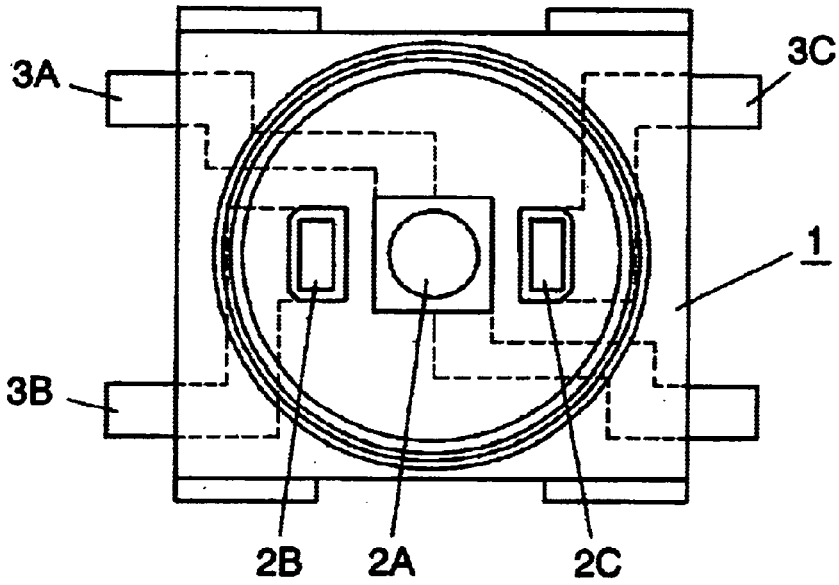
FIG. 28 PRIOR ART
FIG. 28 is a plan view of a switch case that is an essential component of the same push-on switch.
Figure 29:
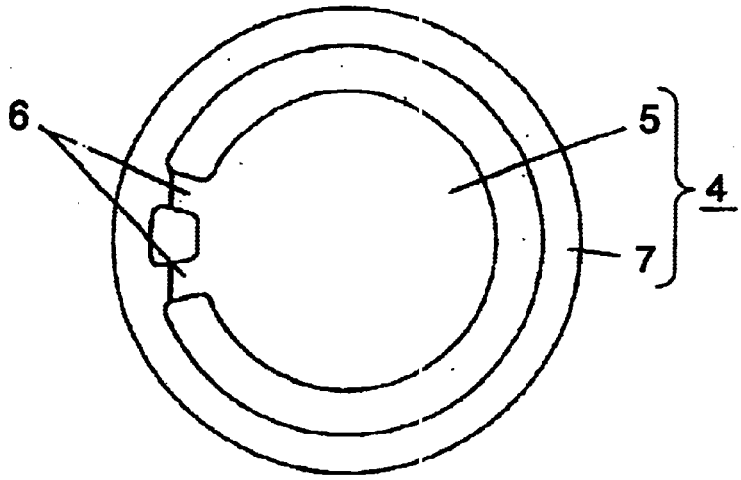
FIG. 29 PRIOR ART
FIG. 29 is a plan view of a movable contact that is an essential component of the same push-on switch.
Figure 30:
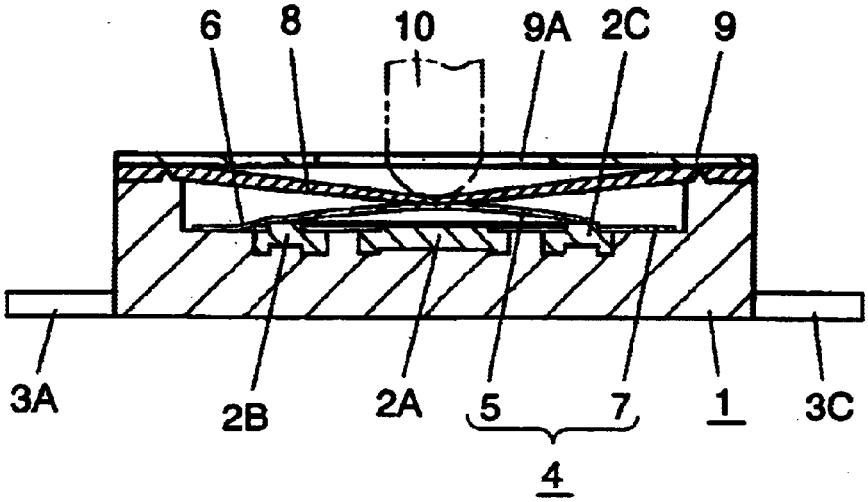
FIG. 30 PRIOR ART
FIG. 30 is a front sectional view for describing the operation mode in pressing operation of the same push-on switch.
Figure 31:
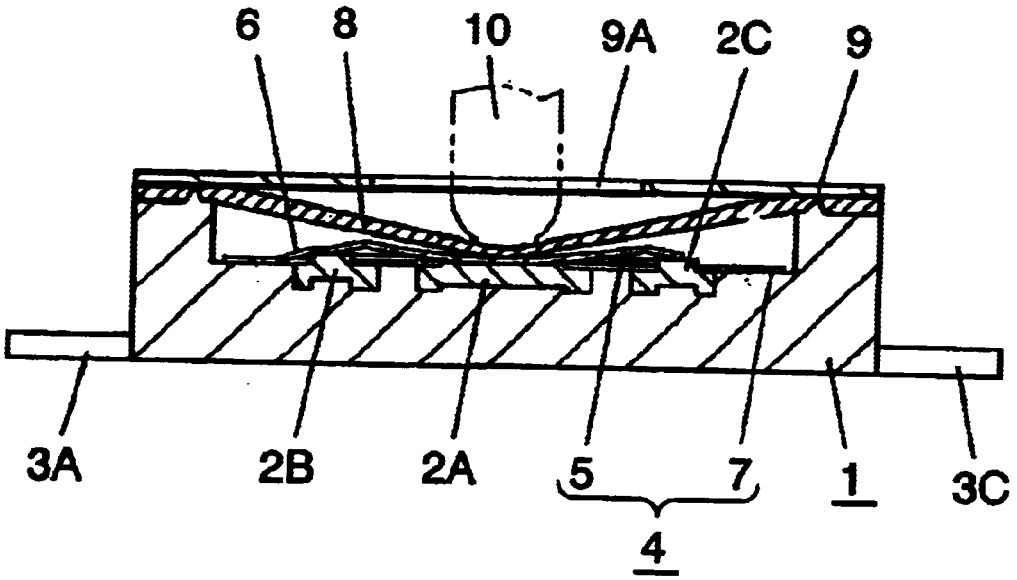
FIG. 31 PRIOR ART
FIG. 31 is a front sectional view for describing the operation mode in pressing operation of the same push-on switch.

Subsequently, when a pressing force is further applied to the driving means 52, the pressing force is applied to the upper surface at the center of the dome portion 34A via the insulating sheet 50. And, when the pressing force exceeds the predetermined level, the second movable contact 34 is reversed with click feeling to become curved downward as shown in FIG. 25. As a result, the underside at the center of the second movable contact 34 comes into contact with the central fixed contact 12A, then the central fixed contact 12A and the peripheral fixed contacts 12B, 12C become conductive. That is, the second switch is turned on.

With the second switch turned on, the spring 61 is flexed so as to become generally flat except the support 64.

Since each of the first movable contact 43 and the spring 61 used generates no click feeling during operation, there is no click feeling in the first-stage operation. This is preferable, for example, when the mechanism is used in a shutter section of a camera.

In the present preferred embodiment, as against the preferred embodiment 1, the operating force is equivalent to the total of the elastically deforming forces of the spring 61, the second movable contact 34, and the first movable contact 43 being flat in shape.

When the pressing force to the operating portion 52B of the driving means 52 is released, the second and first movable contacts 34 and 43, and the spring 61 are restored to their original shapes, pushing the driving means 52 up to the original position. As a result, the second and first switches are turned off.

Thus, the push-on switch of the present preferred embodiment 4 is also capable of two-stage operation, reduced in width and excellent in dust-proofing performance, which is almost free from faulty operation even in case the driving means 52 is accidentally touched during non-operation mode since a space is provided under the pressing portion 52A.

By using the spring 61 of the present preferred embodiment in place of the spring 51 of the preferred embodiment 3, it is possible to easily obtain a push-on switch generating no click feeling in the first-stage operation. That is, according to the present preferred embodiment, as is apparent in the description of the preferred embodiment 3 and preferred embodiment 4, the members other than the spring can be used in common, and this enables making the switch compatible with various products by changing the spring. As a result, it becomes possible to realize a push-on switch reduced in production cost.

What is claimed is:

1. A push-on switch, comprising:

a switch case made of insulating resin opening upward;

a central fixed contact disposed on the inner bottom of said switch case;

two peripheral fixed contacts disposed with said central fixed contact therebetween on the inner bottom of said switch case;

connecting terminals individually electrically connected to said central fixed contact and said two peripheral fixed contacts at the periphery of said switch case;

a first movable contact made of elastic sheet metal, which is provided with a hole at the center thereof, wherein said first movable contact includes a ring portion, and a projection extended to the right and left of said ring portion, and said first movable contact is disposed in said switch case in such manner that said ring portion is arranged above said two peripheral fixed contacts in confronting spaced relation thereto;

a second movable contact having a dome portion curved upward in spherical shape, which is disposed on said ring portion of said first movable contact; and a driving means having a pressing portion for pressing said dome portion of said second movable contact, which is arranged above the second movable contact and is vertically movable.

2. The push-on switch of claim 1, wherein said two peripheral fixed contacts are disposed in symmetric relation to each other with said central fixed contact therebetween;

the periphery diameter of said ring portion is equal to the distance between said two peripheral fixed contacts; and said projection is formed symmetrical to the center of said ring portion, and its width is less than the outer diameter of said ring portion.

3. The push-on switch of claim 1, wherein said first movable contact and said second movable contact are provided with a lug; and said switch case has a groove in its inner wall for guiding said lug.

4. The push-on switch of claim 1, further comprising:

a common fixed contact which comes in contact with at least one of said projections in said switch case; and a common connecting terminal electrically connected to said common fixed contact at the outer periphery of said switch case.

5. The push-on switch of claim 1, wherein the inner bottom of said switch case has a rectangular shape that is longer in the arranged direction of said two peripheral fixed contacts;

at least one of side-walls of said switch case along the longer side of the rectangular shape is flat; and said connecting terminals are disposed on one of the flat side-walls.

6. The push-on switch of claim 5, wherein said switch case includes an enlargement, at the rear of its bottom, having a plane flush with that of said side-wall where said connecting terminal is arranged.

7. The push-on switch of claim 1, wherein said projections are bent so that said ring portion is disposed above said peripheral fixed contacts in confronting spaced relation thereto.

8. The push-on switch of claim 1, wherein said switch case is provided with a shoulder at the inner bottom thereof, and said projection is arranged on the shoulder.

9. The push-on switch of claim 1, further comprising:

an insulating sheet which is disposed over said second movable contact to cover said contact.

10. The push-on switch of claim 1, further comprising:

a spring between the pressing portion of said driving means and said second movable contact, which activates said driving means upward.

11. The push-on switch of claim 10, wherein said first movable contact is formed so as not to be accompanied with a click feeling.

12. The push-on switch of claim 11, wherein said spring is formed so as to be accompanied with a click feeling.

* * * * *